US010995564B2

(12) United States Patent
Miller et al.

(10) Patent No.: US 10,995,564 B2
(45) Date of Patent: May 4, 2021

(54) SYSTEM FOR HANDLING TUBULARS ON A RIG

(71) Applicant: NATIONAL OILWELL VARCO, L.P., Houston, TX (US)

(72) Inventors: Travis James Miller, Cypress, TX (US); Frank Benjamin Springett, Spring, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 16/375,927

(22) Filed: Apr. 5, 2019

(65) Prior Publication Data

US 2019/0309585 A1 Oct. 10, 2019

Related U.S. Application Data

(60) Provisional application No. 62/653,254, filed on Apr. 5, 2018.

(51) Int. Cl.
*E21B 19/15* (2006.01)
*E21B 19/14* (2006.01)
*E21B 19/24* (2006.01)

(52) U.S. Cl.
CPC ..... *E21B 19/14* (2013.01); *E21B 19/155* (2013.01); *E21B 19/24* (2013.01)

(58) Field of Classification Search
CPC ..... E21B 19/14; E21B 19/155; E21B 19/20; E21B 19/16; E21B 19/06; E21B 19/10; E21B 19/167; E21B 19/18; B62B 1/12; B62B 1/14; B62B 1/10; E21C 27/22
See application file for complete search history.

(56) References Cited

U.S. PATENT DOCUMENTS 1,818,278 A * 8/1931 Siler ..... E21B 19/14 414/22.63
2,531,930 A 11/1950 Woolslayer et al.
2,615,681 A * 10/1952 True ..... E21B 19/20 166/77.51

(Continued)

FOREIGN PATENT DOCUMENTS

CA 2911388 A1 11/2014
CA 2855105 A1 12/2015

(Continued)

OTHER PUBLICATIONS

"International Application Serial No. PCT US2019 025942, International Search Report dated Jun. 27, 2019", 4 pgs.

(Continued)

*Primary Examiner* — Gregory W Adams
(74) *Attorney, Agent, or Firm* — Schwegman Lundberg & Woessner, P.A.

(57) ABSTRACT

A system for handling tubulars on a rig may include a top handling device configured for arrangement on the rig and for handling a top portion of a tubular to and from a setback area. The system may also include a lower handling device configured for arrangement on the rig and for handling a bottom portion of the tubular between well center and a release position. The system may also include a bottom handling device configured for arrangement on the rig and for handling the bottom portion of the tubular between the release position and the setback area.

19 Claims, 18 Drawing Sheets

(56) References Cited

U.S. PATENT DOCUMENTS 2,735,556 A 2/1956 Stone
2,885,096 A 5/1959 De Jarnett
2,946,464 A 7/1960 Guier
3,225,949 A * 12/1965 Erickson ..... B66F 9/10 414/629
3,272,365 A * 9/1966 Stevens ..... B66F 9/105 414/633
3,533,516 A * 10/1970 Guier ..... E21B 19/14 414/22.51
3,615,027 A * 10/1971 Ham ..... E21B 19/14 414/22.71
3,747,789 A * 7/1973 Shipley ..... B66F 9/10 414/633
3,768,663 A 10/1973 Turner et al.
3,921,823 A * 11/1975 Bourree ..... E21B 19/002 414/22.64
3,976,207 A * 8/1976 Schultz ..... E21B 15/00 414/22.51
3,994,350 A 11/1976 Smith et al.
4,042,123 A * 8/1977 Sheldon ..... E21B 19/14 414/22.71
4,117,941 A * 10/1978 McCleskey, Jr. ..... E21B 19/002 414/22.63
4,274,778 A 6/1981 Putnam et al.
4,289,442 A * 9/1981 Stevens ..... B66F 9/10 414/629
4,348,920 A * 9/1982 Boyadjieff ..... E21B 19/20 81/57.25
4,397,605 A * 8/1983 Cowgill ..... E21B 19/14 294/116
4,531,875 A * 7/1985 Krueger ..... E21B 19/20 414/22.68
4,591,006 A 5/1986 Hutchison et al.
4,621,974 A 11/1986 Krueger
4,680,519 A * 7/1987 Chand ..... G05B 19/4086 318/568.19
4,715,761 A * 12/1987 Berry ..... E21B 19/14 104/35
4,738,321 A 4/1988 Olivier
5,038,871 A 8/1991 Dinsdale
5,211,251 A 5/1993 Woolslayer
5,813,286 A * 9/1998 Hansen ..... B25J 18/00 248/276.1
5,921,329 A 7/1999 Armstrong
6,047,771 A * 4/2000 Røynestad ..... E21B 19/084 166/77.52
6,260,646 B1 * 7/2001 Fernandez ..... B62B 3/0612 180/12
6,412,576 B1 7/2002 Meiners
7,137,616 B2 * 11/2006 Kysely ..... E04H 17/265 254/30
7,249,639 B2 * 7/2007 Belik ..... E21B 19/00 175/162
7,370,707 B2 * 5/2008 McDaniel ..... E21B 19/004 166/380
7,726,929 B1 6/2010 Orgeron
7,905,311 B2 * 3/2011 Brown ..... B66F 9/105 180/210
7,946,795 B2 * 5/2011 Orgeron ..... E21B 19/155 414/22.55
7,984,757 B1 7/2011 Keast et al.
8,191,637 B2 6/2012 Havinga
8,550,761 B2 * 10/2013 Belik ..... E21B 19/14 414/22.63
8,690,508 B1 * 4/2014 Orgeron ..... E21B 19/155 414/22.55
9,291,010 B1 3/2016 Barnes
10,384,907 B2 8/2019 Upmeier et al.
2004/0057815 A1 3/2004 Woolslayer et al.
2005/0126792 A1 6/2005 Berry
2006/0081379 A1 4/2006 Fehres et al.
2006/0104747 A1 5/2006 Zahn et al.
2006/0124316 A1 6/2006 Pietras
2006/0231344 A1 10/2006 Drzewiecki
2006/0249292 A1 11/2006 Guidry
2007/0062705 A1 3/2007 Schats et al.
2007/0114069 A1 * 5/2007 Hooper ..... E21B 19/16 175/85
2008/0202812 A1 8/2008 Childers et al.
2008/0238095 A1 10/2008 Yater et al.
2008/0296065 A1 12/2008 Standal
2009/0283324 A1 11/2009 Konduc et al.
2010/0193198 A1 8/2010 Murray et al.
2010/0303586 A1 12/2010 Hankins et al.
2011/0079434 A1 4/2011 Belik et al.
2011/0120730 A1 * 5/2011 Clasen ..... E21B 19/165 166/381
2011/0226485 A1 9/2011 Seneviratne et al.
2012/0018222 A1 1/2012 Hankins et al.
2013/0075114 A1 3/2013 Dekker et al.
2013/0142607 A1 * 6/2013 Ditzler ..... E02F 3/38 414/727
2014/0054089 A1 2/2014 Sondervik
2014/0097027 A1 4/2014 Marica et al.
2014/0145408 A1 * 5/2014 Midas ..... B62B 3/02 280/47.131
2014/0202769 A1 7/2014 Magnuson
2015/0053424 A1 2/2015 Wiens et al.
2015/0232272 A1 8/2015 Magnuson
2015/0275596 A1 10/2015 Hickie
2016/0060979 A1 3/2016 Magnuson
2016/0115745 A1 4/2016 Bisel
2016/0145954 A1 5/2016 Helms et al.
2016/0160586 A1 6/2016 Keogh et al.
2016/0168929 A1 6/2016 Magnuson et al.
2017/0234088 A1 8/2017 Orr et al.
2018/0334865 A1 11/2018 Miller et al.
2019/0145197 A1 5/2019 Callaghan
2020/0040673 A1 2/2020 Donnally et al.
2020/0040674 A1 2/2020 Mckenzie et al.

FOREIGN PATENT DOCUMENTS

CN 108266139 A 7/2018
CN 110792399 A 2/2020
EP 1953334 A2 8/2008
GB 2091788 A 8/1982
GB 2532267 A 5/2016
NO 20151648 A1 12/2015
WO WO-8800274 A2 * 1/1988 ..... E21B 19/16
WO WO-9958811 A1 11/1999
WO 0123701 4/2001
WO WO-2004018829 A1 3/2004
WO WO-2013082172 A1 6/2013
WO WO-2014179730 A1 11/2014
WO WO-2016024859 A1 2/2016
WO WO-2016197255 A1 12/2016
WO WO-2017039996 A1 3/2017
WO 2017087595 5/2017
WO WO-2017190120 A1 11/2017
WO WO-2017193204 A1 11/2017
WO WO-2020028852 A1 2/2020
WO WO-2020028853 A1 2/2020
WO WO-2020028856 A1 2/2020
WO WO-2020028858 A1 2/2020
WO WO-2020151386 A1 7/2020
WO WO-2020172407 A1 8/2020

OTHER PUBLICATIONS

"International Application Serial No. PCT US2019 025942, Written Opinion dated Jun. 27, 2019", 9 pgs.
U.S. Appl. No. 16/098,160, filed Nov. 1, 2018, System and Method for Offline Standbuilding.
U.S. Appl. No. 16/431,533, filed Jun. 4, 2019, Devices, Systems, and Methods for Robotic Pipe Handling.
U.S. Appl. No. 16/836,365, filed Mar. 31, 2020, Robotic Pipe Handling From Outside a Setback Area.
U.S. Appl. No. 16/431,540, filed Jun. 4, 2019, Devices, Systems, and Methods for Top Drive Clearing.

(56) References Cited

OTHER PUBLICATIONS

U.S. Appl. No. 16/786,345, filed Feb. 10, 2020, Quick Coupling Drill Pipe Connector.
"U.S. Appl. No. 16/098,160, Advisory Action dated Jul. 22, 2020", 5 pgs.
"U.S. Appl. No. 16/098,160, Examiner Interview Summary dated Jun. 23, 2020", 3 pgs.
"U.S. Appl. No. 16/098,160, Final Office Action dated Apr. 30, 2020", 7 pgs.
"U.S. Appl. No. 16/098,160, Non Final Office Action dated Sep. 30, 2019", 8 pgs.
"U.S. Appl. No. 16/098,160, Preliminary Amendment filed Nov. 1, 2018", 5 pgs.
"U.S. Appl. No. 16/098,160, Response filed Jan. 30, 2020 to Non Final Office Action dated Sep. 30, 2019", 8 pgs.
"U.S. Appl. No. 16/098,160, Response filed Jun. 30, 2020 to Final Office Action dated Apr. 30, 2020", 8 pgs.
"U.S. Appl. No. 16/098,160, Response filed Aug. 24, 2020 to Advisory Action dated Jul. 22, 2020", 9 pgs.
"U.S. Appl. No. 16/431,540, Non Final Office Action dated Jun. 10, 2020", 13 pgs.
"U.S. Appl. No. 16/431,540, Response Filed Sep. 10, 2020 to Non Final Office Action dated Jun. 10, 2020", 24 pgs.
"Canadian Application Serial No. 3,022,888, Voluntary Amendment filed Jul. 12, 2019", 10 pgs.
"International Application Serial No. PCT/CA2017/000125, International Preliminary Report on Patentability dated Nov. 22, 2018", 6 pgs.
"International Application Serial No. PCT/CA2017/000125, International Search Report dated Aug. 14, 2017", 3 pgs.
"International Application Serial No. PCT/CA2017/000125, Written Opinion dated Aug. 14, 2017", 4 pgs.
"International Application Serial No. PCT/CN2019/124443, International Search Report dated Mar. 5, 2020", 4 pgs.
"International Application Serial No. PCT/CN2019/124443, Written Opinion dated Mar. 5, 2020", 4 pgs.
"International Application Serial No. PCT/US2019/025942, Response filed Feb. 5, 2020 to Written Opinion dated Feb. 27, 2019", 14 pgs.
"International Application Serial No. PCT/US2019/025942, Response filed Apr. 23, 2020 to Written Opinion dated Apr. 23, 2020", 14 pgs.
"International Application Serial No. PCT/US2019/025942, Written Opinion dated Feb. 24, 2020", 8 pgs.
"International Application Serial No. PCT/US2019/025942, Written Opinion dated Jul. 23, 2020", 5 pgs.
"International Application Serial No. PCT/US2019/044974, International Search Report dated Oct. 24, 2019", 6 pgs.
"International Application Serial No. PCT/US2019/044974, Response filed Jun. 2, 2020 to Written Opinion dated Oct. 24, 2019", 13 pgs.
"International Application Serial No. PCT/US2019/044974, Response filed Aug. 18, 2020 to Written Opinion dated Jun. 19, 2020", 4 pgs.
"International Application Serial No. PCT/US2019/044974, Written Opinion dated Jun. 19, 2020", 7 pgs.
"International Application Serial No. PCT/US2019/044974, Written Opinion dated Oct. 24, 2019", 6 pgs.
"International Application Serial No. PCT/US2019/044976, International Search Report dated Oct. 18, 2019", 5 pgs.
"International Application Serial No. PCT/US2019/044976, Response filed Jun. 30, 2020 to Written Opinion dated Oct. 18, 2019", 11 pgs.
"International Application Serial No. PCT/US2019/044976, Response filed Aug. 25, 2020 to Written Opinion dated Jun. 26, 2020", 3 pgs.
"International Application Serial No. PCT/US2019/044976, Written Opinion dated Jun. 26, 2020", 4 pgs.
"International Application Serial No. PCT/US2019/044976, Written Opinion dated Oct. 18, 2019", 8 pgs.
"International Application Serial No. PCT/US2019/044979, International Search Report dated Oct. 22, 2019", 6 pgs.
"International Application Serial No. PCT/US2019/044979, Response filed Jun. 3, 2020 to Written Opinion dated Oct. 22, 2019", 12 pgs.
"International Application Serial No. PCT/US2019/044979, Response filed Aug. 25, 2020 to Written Opinion dated Jun. 26, 2020", 3 pgs.
"International Application Serial No. PCT/US2019/044979, Written Opinion dated Jun. 26, 2020", 4 pgs.
"International Application Serial No. PCT/US2019/044979, Written Opinion dated Oct. 22, 2019", 7 pgs.
"International Application Serial No. PCT/US2019/044983, International Search Report dated Oct. 22, 2019", 5 pgs.
"International Application Serial No. PCT/US2019/044983, Written Opinion dated Oct. 22, 2019", 6 pgs.
"International Application Serial No. PCT/US2020/019039, International Search Report dated May 15, 2020", 2 pgs.
"International Application Serial No. PCT/US2020/019039, Written Opinion dated May 15, 2020", 4 pgs.
"U.S. Appl. No. 16/098,160, Non Final Office Action dated Oct. 6, 2020", 8 pgs.
"U.S. Appl. No. 16/431,540, Final Office Action dated Nov. 19, 2020", 10 pgs.
"International Application Serial No. PCT/US2019/025942, International Preliminary Report on Patentability dated Oct. 30, 2020", 7 pgs.
"International Application Serial No. PCT/US2019/025942, Response filed Sep. 22, 2020 to Written Opinion dated Jul. 23, 2020", 4 pgs.
"International Application Serial No. PCT/US2019/044974, International Preliminary Report on Patentability dated Nov. 11, 2020", 7 pgs.
"International Application Serial No. PCT/US2019/044976, Written Opinion dated Nov. 6, 2020", 6 pgs.
"International Application Serial No. PCT/US2019/044979, International Preliminary Report on Patentability dated Nov. 18, 2020", 7 pgs.
"International Application Serial No. PCT/US2019/124443, Response filed Nov. 24, 2020 to Written Opinion dated Mar. 5, 2020", 10 pgs.

* cited by examiner

SYSTEM FOR HANDLING TUBULARS ON A RIG

CROSS-REFERENCE TO RELATED APPLICATIONS

This application claims priority to U.S. Provisional Application Ser. No. 62/653,254, filed on Apr. 5, 2018, and entitled "SYSTEM FOR HANDLING TUBULARS ON A RIG." This application is also related to U.S. Provisional Application Ser. No. 62/506,813, filed on May 16, 2017, and entitled "RIG-FLOOR PIPE LIFTING MACHINE." The content of both of the above-mentioned applications are hereby incorporated by reference herein in their entireties.

TECHNOLOGICAL FIELD

The present disclosure relates to manipulating or handling tubulars on a drill rig. More particularly, the present application relates to robotically manipulating or handling tubulars between well center and a set back area. Still more particularly, the present application relates to robotically carrying drill pipe and/or drill collar between a well center and the set back area.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Drilling of wells involves tripping of the drill string, during which drill pipes are lowered into (tripping in) or pulled out of (tripping out) a well. Drillers or well operators may perform tripping to change all or a portion of the bottom hole assembly, such as to change a drill bit. When tripping in, stands or lengths of drill pipe may be supplied from a storage position in a setback area of the drill rig and connected end-to-end to lengthen the drill string as the it is fed into the well. When tripping out, stands or lengths of drill pipe may be disconnected from the drill string and may be positioned in the setback area as the drill string is pulled out of the well.

Tripping has conventionally been performed with human operators. In particular, while an elevator or top drive may be used to carry the load of a stand of drill pipe during trip in and trip out operations, human operators may typically maneuver the drill pipe stands around the drill floor, such as between the well center and the setback area. For example, a first human operator may be positioned on the drill floor, at or near the well, to maneuver a lower end of drill pipe stands as they are tripped into or out of the well, while a second human operator may be positioned on or above the racking board to maneuver an upper end of drill pipe stands as the stands are moved between the well and the setback area. Operators often use ropes and/or other tools to maneuver the drill pipe stands on or above the drill floor. Such work is labor-intensive and can be dangerous. Moreover, tripping in and tripping out operations may be limited by the speed at which the human operators can maneuver the stands between well center and the setback area.

Still further, a drill string may be made up of a drill head arranged at the deepest tip of the string. A substantially heavy pipe, referred to as drill collar, may be arranged behind the drill head to create a weight on the deepest portions of the drill string. More conventional drill pipe may be arranged behind the drill collar and extending upward to the drill floor. When tripping in and/or out of a well, the handling of the drill collar can be much more labor intensive and potentially dangerous due to the very heavy nature of this portion of the drill string.

SUMMARY

The following presents a simplified summary of one or more embodiments of the present disclosure in order to provide a basic understanding of such embodiments. This summary is not an extensive overview of all contemplated embodiments and is intended to neither identify key or critical elements of all embodiments, nor delineate the scope of any or all embodiments.

In one or more embodiments, a system for handling tubulars on a rig may include a top handling device configured for arrangement on the rig and for handling a top portion of a tubular to and from a setback area. The system may also include a lower handling device configured for arrangement on the rig and for handling a bottom portion of the tubular between well center and a release position. The system may also include a bottom handling device configured for arrangement on the rig and for handling the bottom portion of the tubular between the release position and the setback area.

In one or more embodiments, a tubular handling device for handling tubulars on a rig floor may include a rig floor lifting machine having a pipe lifting and carrying condition and a free condition, wherein, in the pipe lifting and carrying condition, the rig floor lifting machine is configured to engage a bottom portion of a tubular, lift the weight of the tubular, and carry the tubular to a setback area. The device may also include an articulable assembly configured to control the position of the rig floor lifting machine when the rig floor lifting machine is in a free condition.

In one or more embodiments, a method of handling tubulars on a rig may include decoupling a tubular from a pipe string, swinging the tubular from well center to a release area, and setting the tubular on the drill floor with a top drive elevator. The method may also include moving a rig floor lifting machine to the release area with an articulable assembly. The method may also include engaging the tubular with the rig floor lifting machine and carrying the tubular to a setback area with the rig floor lifting machine.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in one or more embodiments, relates to a system for handling tubulars on a drill rig. More particularly, the system relates to a robotic drill floor system for handling tubulars between well center and a setback area during tripping operations. More particularly, the system relates to a robotic drill floor system that has the capacity, not only to manipulate pipe in plan view, but, also to carry the weight of the pipe as it does so. As such, and in contrast to human operators, the system may have the ability to support the weight of the pipe during handling operations freeing up the top drive and/or top drive elevators to perform other operations.

Figure 1:
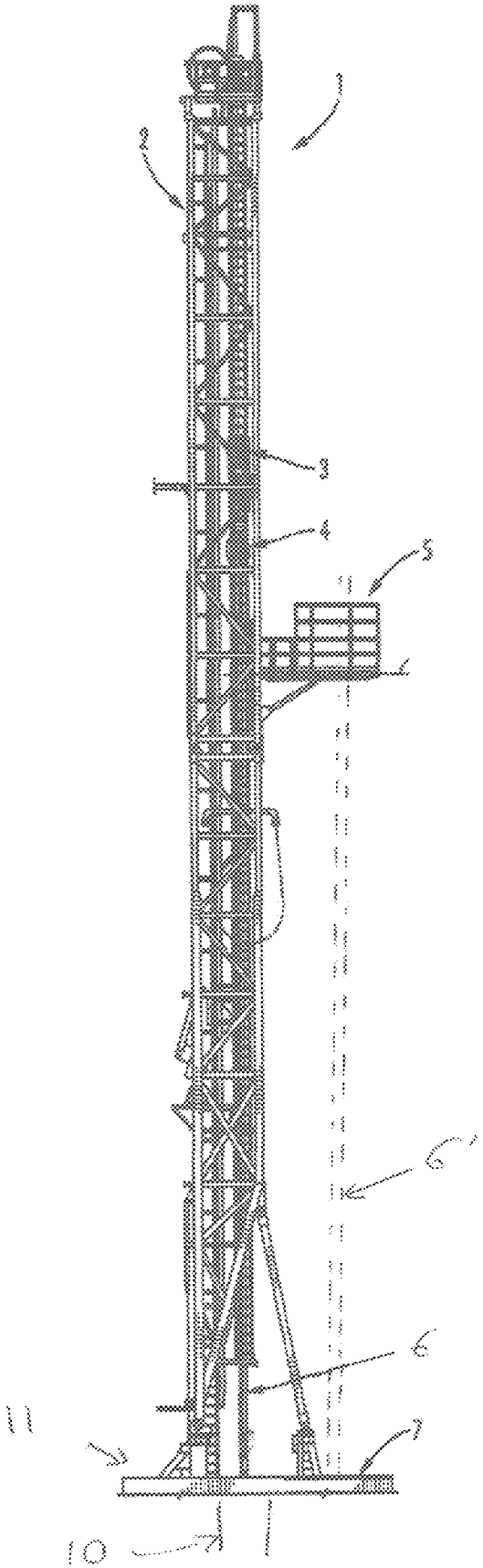
FIG. 1 is a side view of a drill floor and a mast extending upward from the drill floor.

Referring now to FIG. 1, a side view showing a rig 1 (e.g., an oil rig) positioned above a well 10 is provided. The rig 1 may include a mast 2 erected from a rig floor 11 and the rig 1, mast 2, and rig floor 11 may be supported by a substructure elevating the rig floor above a drill surface. Tubulars 6 (e.g., pipes or pipe stands) can be raised and lowered in the well 10 using a traveling block 3 and/or a top drive 4 suspended from a travelling block 3. Tubulars 6 can be rotated using the top drive 4. Tubulars 6' can be stored in a setback area 7. When stored, upper ends of tubulars 6' may be held in a fingerboard 5.

This disclosure relates generally to methods and apparatus for handling the tubulars 6, 6' on the rig 1. More specifically, this disclosure relates to a system for handling the tubular 6 from its location above the well 10 or at well center to a location in the setback area 7, and/or handling the tubular 6' from its location on the setback area 7 to a location above the well 10.

Figure 2A:
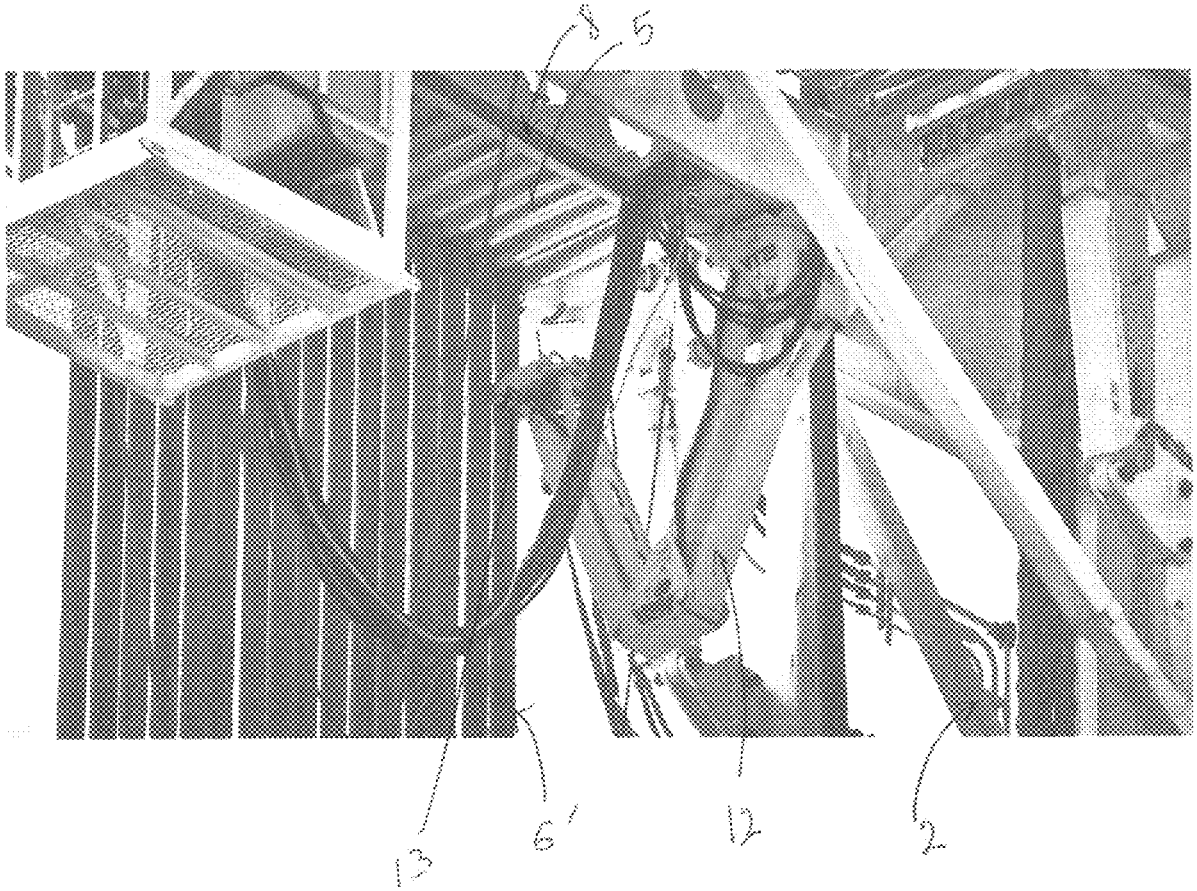
FIG. 2A is a perspective view of a top handling device, according to one or more embodiments.

FIG. 2A is a perspective view of a top handling device 15 for handling tubulars in accordance with an embodiment of the invention. The top handling device may be a means mounted on the mast 2, for horizontally displacing an upper end of tubulars 6, 6'. The top handling device may include a robotic arm 12, such as a Stand Transfer Device™ (STD) designed to rack tubulars between the fingerboard 5 and a location above the well 10. The robotic arm 12 can be terminated by a claw 13 configured to grip the tubulars 6, 6'. The robotic arm 12 can be movable along a rail 8 so as to guide the top of the tubular too and/or from the setback area and the fingerboard.

Figure 2B:
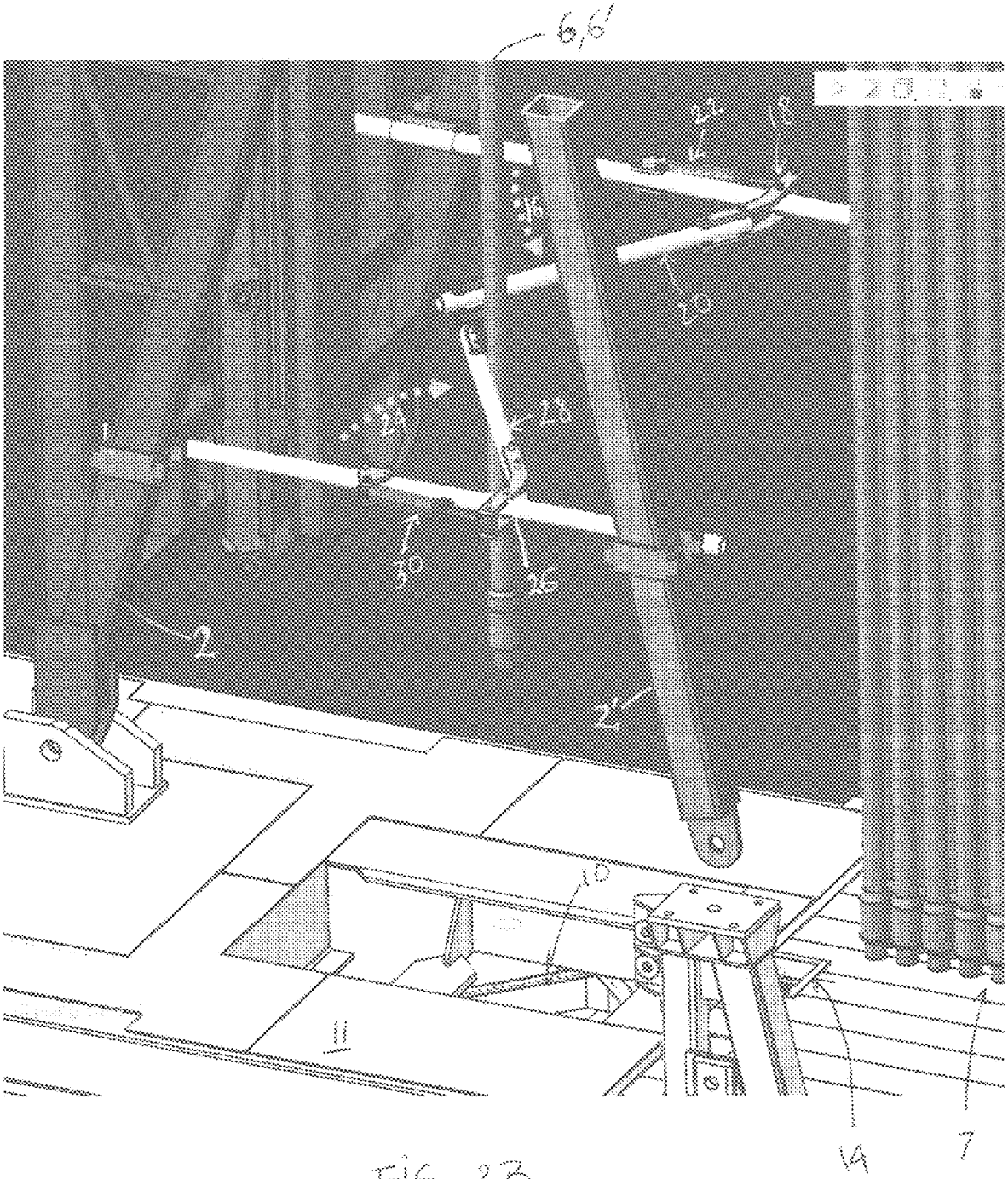
FIG. 2B is a perspective view of a lower handling device, according to one or more embodiments.

FIG. 2B is a perspective view of a lower handling device 17. The lower handling device 17 may be a means for guiding a bottom portion of the tubulars 6, 6' over the well 10, the mouse hole 14, the setback area 7, and/or the V-door area. The lower handling device may include a first crossbar 18 affixed on one side to the mast 2, which is in turn affixed to the rig floor 11, and on the other side to a column 2' (far side not shown in FIG. 2B). The column 2' can also be affixed to the mast 2 and/or the rig floor 11. The lower handling device may include a first catcher arm 20 hinged on a first vertical pivot mounted on the first crossbar 18. The first catcher arm 20 may be horizontally or substantially horizontally, rotatable around the first vertical pivot, for example in a direction indicated by arrow 16. The lower handling device may include a first actuator 22 (e.g., a hydraulic cylinder) coupled to the first catcher arm 20 and configured to rotate the first catcher arm 20 relative to the first crossbar 18. The lower handling device may also include a second cross bar 26 affixed on one side to the mast 2, and on the other side to a column 2' (partially shown in FIG. 2B), which can also be affixed to the mast 2 and/or the rig floor 11. The lower handling device may also include a second catcher arm 28 hinged on a second vertical pivot mounted on the second crossbar 26. The second catcher arm 28 may be horizontally or substantially horizontally, rotatable around to the second vertical pivot, for example in a direction indicated by arrow 24. The lower handling device may include a second actuator 30 (e.g., a hydraulic cylinder) coupled to the second catcher arm 28 and configured to rotate the second catcher arm 28 relative to the second crossbar 26. The second vertical pivot may be offset from the first vertical pivot by a distance that is shorter than the sum of lengths of the first catcher arm 20 and the second catcher arm 28. That is, the spacing of the crossbars 18/26 may be shorter than the length of the first and second catcher arms added together. As shown, the spacing may be such that an end of the first catcher arm 20 can be placed over an end of the second catcher arm 28 to form a V-shaped guide for the tubular 6, 6'. As such, when one of the tubulars 6, 6' is suspended from an elevator coupled to the top drive 4 (shown in FIG. 1), the first catcher arm 20 and the second catcher arm 28 can be used to prevent the tubular 6, 6' from swinging and to controllably guide the tubular 6, 6' over the well 10, the mouse hole 14, the setback area 7 and/or the V-door area.

In order to maintain a V-shaped guide for the tubulars 6, 6' when the first catcher arm 20 and the second catcher arm 28 rotate horizontally under a force exerted respectively by the first actuator 22 and the second actuator 30, the lower handling device may include a control system. The control system may include a plurality of sensors configured to determine and/or monitor a position of the first catcher arm 20 and a position of the second catcher arm 28. The control system may include a controller driving the first actuator 22 and the second actuator 30 and the controller may be configured to mirror the position of the first catcher arm 20 with the position of the second catcher arm 28 and/or vice versa such that the position of the valley of the V-shaped guide may be generally centered between the crossbars 18/26. Where other positions of the tubular are desired, the control system may adjust the catcher arms relative to one another to move the position of the V-shaped guide along the length of one or both of the catcher arms. It is to be appreciated that the V-shaped guide may be maintained as the catcher arms rotated from the position shown in FIG. 2B to a position where the catcher arms are parallel to one another. Then, as the catcher arms continue to be rotated, the V-shaped guide may be recreated and continue as the catcher arms continue to rotate and urge the tubular toward the setback area. (see e.g., FIG. 3B).

When not in use, the first catcher arm 20 and the second catcher arm 28 may be stored out of the path along the well 10, the mouse hole 14, the setback area 7 and/or the V-door area by rotating the first catcher arm 20 and the second catcher arm 28 in the directions reverse from the arrows 16 and 24, respectively.

Figure 2C:
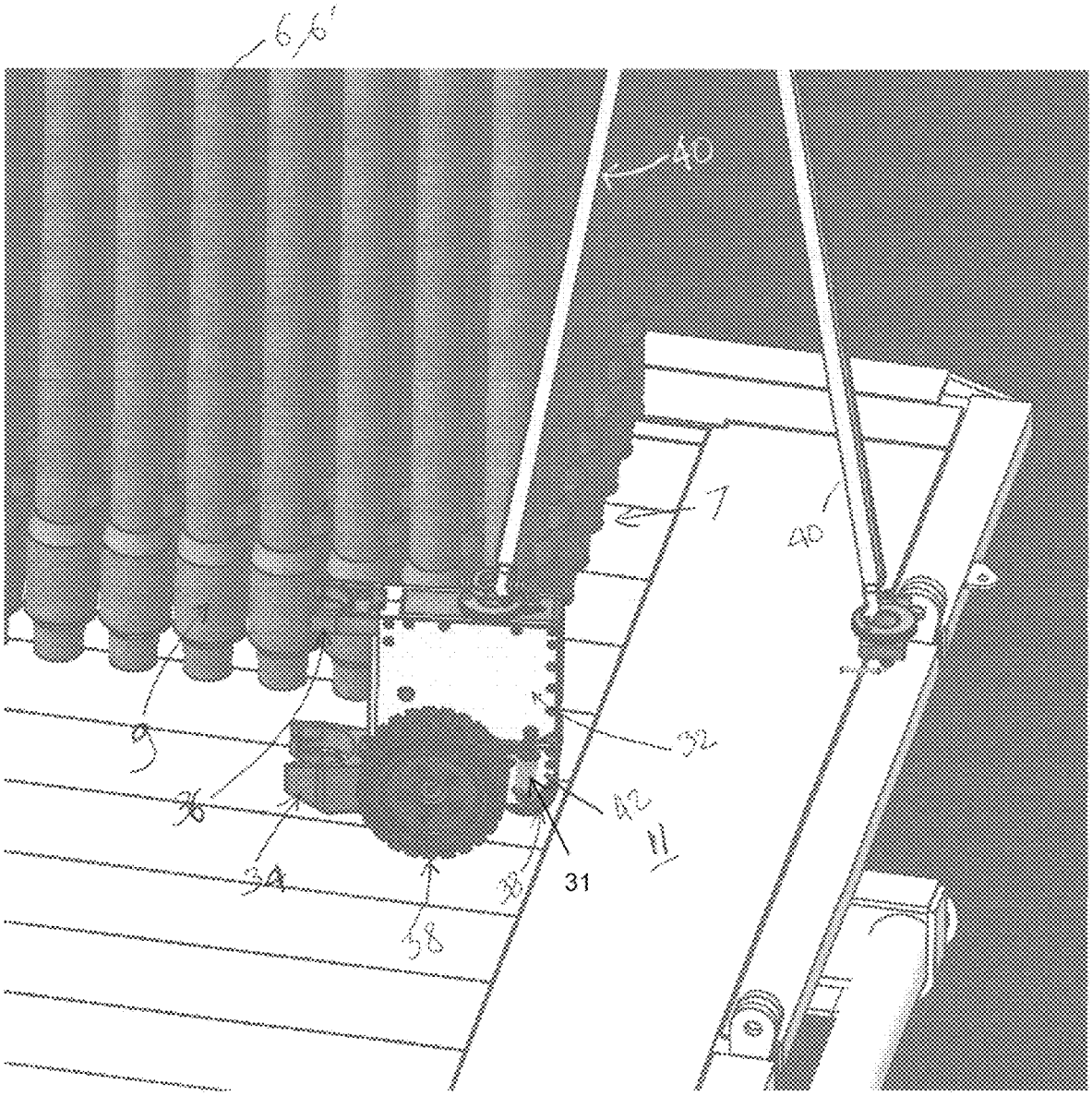
FIG. 2C is a perspective view of a bottom handling device, according to one or more embodiments.

FIG. 2C is a perspective view showing a bottom handling device of the system for handling the tubulars in accordance with the embodiment of the invention. The bottom handling device may be a means for displacing horizontally a lower end of the tubulars 6, 6' and/or a means for displacing horizontally and carrying a lower end of the tubulars 6, 6'. The bottom handling device may include a rig-floor pipe lifting machine 32. The rig-floor pipe lifting machine 32 may include a fork, jaw, or lifting shoe 34 coupled to a frame. The fork 34 may be sized to engage a tool-joint 9 of the tubulars 6, 6'. The rig-floor pipe lifting machine 32 may also include a concave pad 36 coupled to the frame. The concave pad 36 may be vertically aligned with the fork 34. The rig-floor pipe lifting machine 32 may include a plurality of wheels 38 mounted on a pair of swing arms 42. More particularly, the plurality of wheels may include a pair of drive wheels arranged on either side of the frame and may include a rear caster wheel, for example. The main drive wheels may include an axle extending across the frame or may at least define a pivot axis extending through both of the drive wheels at their centers. The fork 34 and the pad 36 may be vertically aligned with one another, arranged on a front of the frame, and offset from the axle or axis of the drive wheels. The alignment of the fork and pad and the offset nature of them may be such that when the lifting machine engages the bottom of a pipe and lifts it, the weight of the pipe on the fork 34 may cause the lifting machine 32 to tend to rotate about the axle, which may cause the pad 36 to engage the pipe and establish stability and alignment with the pipe. As such, and as discussed in more detail below, the caster wheel may be disengaged from the ground allowing for the balanced lifting machine to be more maneuverable about the drill floor.

Still further, the bottom handling device may be adapted to accommodate misalignment of the upper section (with the "shoes") and the lower section (with the wheels) by a pinned joint in between the sections. In one or more embodiments, the bottom handling device may include one actuated axis (controlled by the hydraulic cylinder or by the pipe when the caster wheel is lifted) and a second compliance axis which may be centered by a spring or other biasing mechanism 31 but may otherwise be uncontrolled. This system may allow for load in the shoes 34 to be balanced equally on both wheels 38 and may allow the bottom handling device to tip side to side to accommodate the angle of the tubular 6, 6'.

In order to control the movement of the rig-floor pipe lifting machine 32 on the rig floor 11, the lower handling device may include a navigation system. For example, the navigation system may include a link 40 attached between the rig-floor pipe lifting machine 32 and the rig floor 11. The navigation system may include a plurality of sensors mounted on the link 40. Each of the plurality of sensors may generate a signal indicative of a position or a movement of a portion of the link 40. The navigation system may include a controller programmed to drive at least one of the plurality of wheels 38 based on the signals generated by the sensors. The link 40 can also deliver power (e.g., hydraulic power, electric power, etc.) to the rig-floor pipe lifting machine 32 for rotating one or more of the plurality of wheels 38.

The three components of the system for handling the tubulars that have been illustrated in FIGS. 2A, 2B, and 2C may cooperate for displacing the tubulars 6, 6', for example under the direction of a master controller. An example sequence of steps illustrating a use of the system for handling the tubulars in accordance with an embodiment of the invention is shown in FIGS. 3A-3I.

Figure 3A:
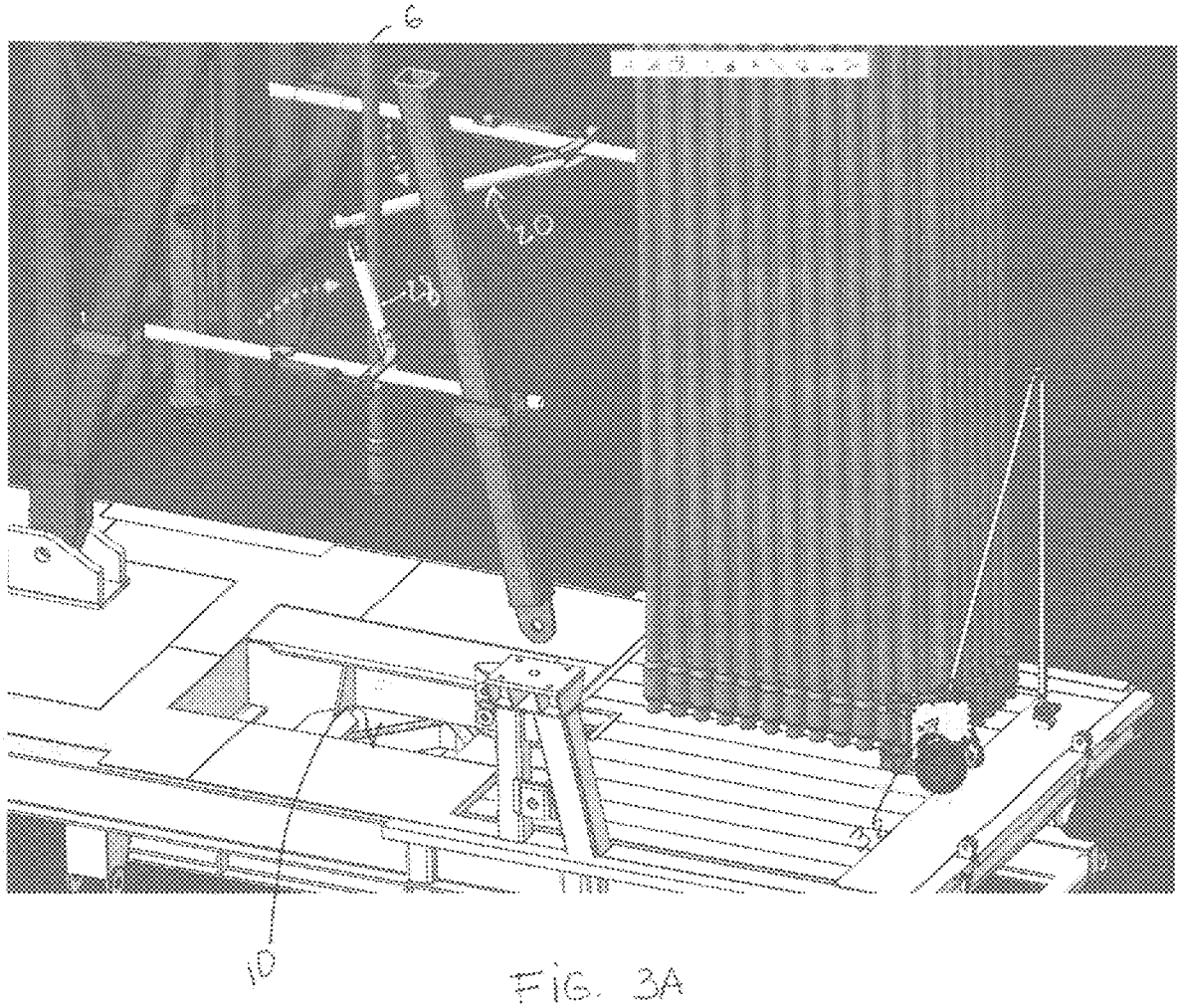
FIG. 3A is a perspective view of the lower and bottom handling devices on a drill rig with a drill pipe at or near well center, according to one or more embodiments.

As shown in FIG. 3A, a tubular 6 may be removed from the top of a drill string during tripping out operations, for example. After being removed, the tubular 6 may be suspended for example from a top drive 4 (shown in FIG. 1) by an elevator. With a goal of urging or guiding the tubular 6 toward the setback area or to a position where the bottom handling device can access the bottom of the tubular 6, the first catcher arm 20 and the second catcher arm 28 may push the tubular 6 toward a position offline (e.g., away from well center) from the well 10.

Figure 3B:
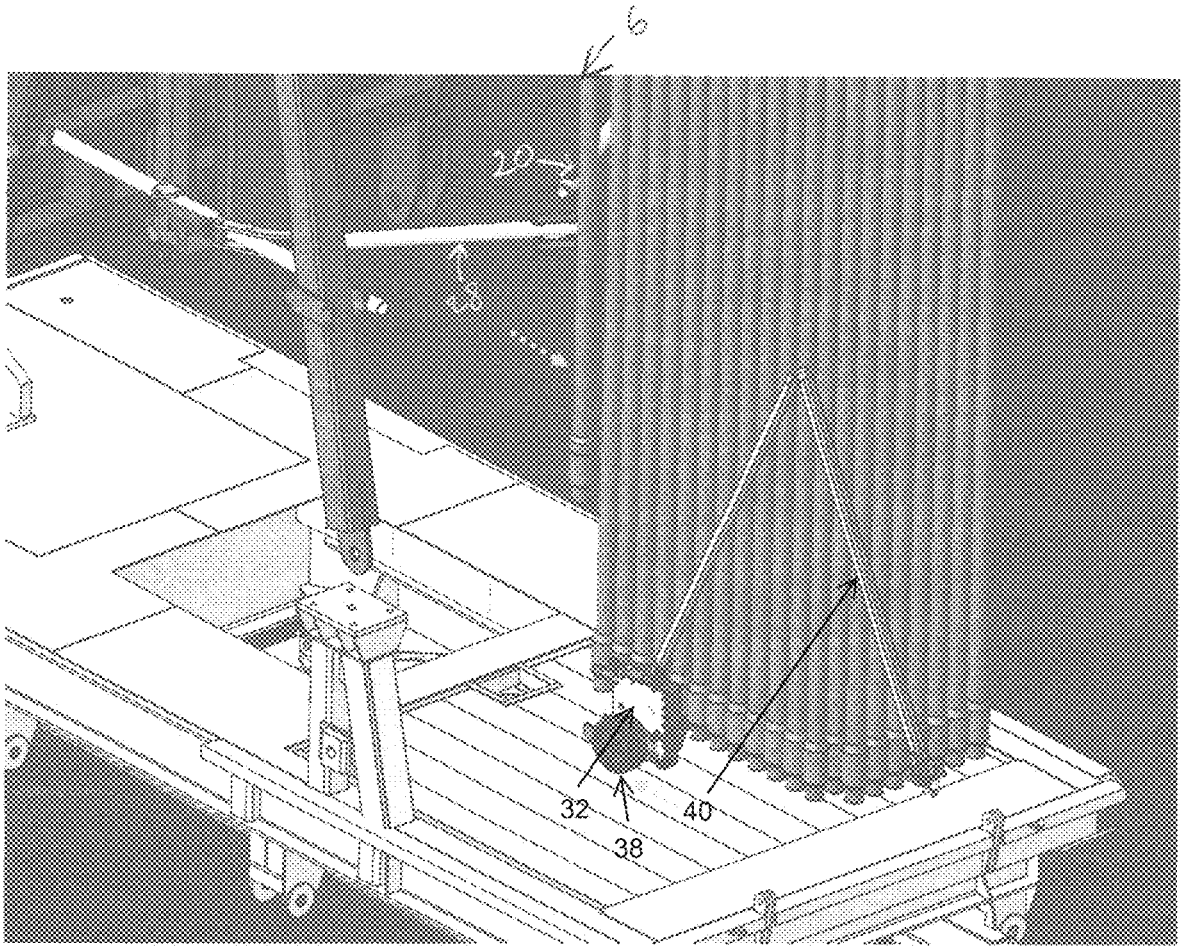
FIG. 3B is a perspective view of the lower and bottom handling devices on a drill rig with the drill pipe moved away from well center toward the setback area, according to one or more embodiments.

As shown in FIG. 3B, the tubular 6 may be positioned in an offline position and the rig-floor pipe lifting machine 32 may move toward the offline position. The rig-floor pipe lifting machine may receive commands from the link 40 and may operate by way of powering its own wheels 38. That is, the link 40 may follow the lifting machine 32, monitor its position, and provide a source of power, but the motion of the lifting machine 32 may be due to its own power via drive wheels to travel across the rig floor to the offline position.

Figure 3C:
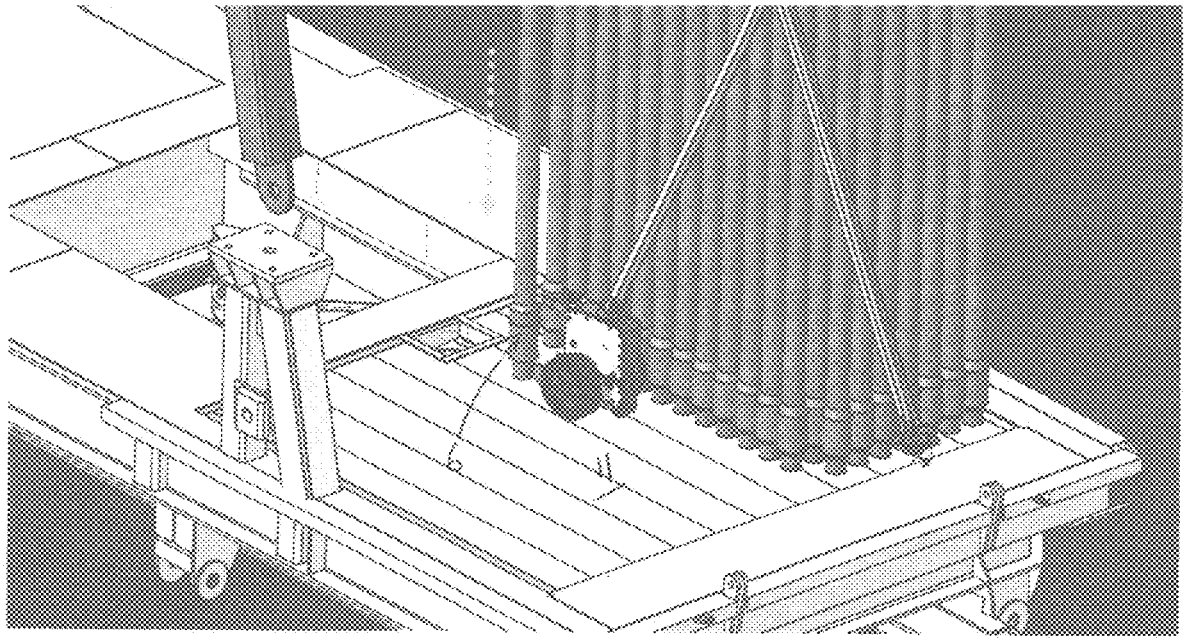
FIG. 3C is a perspective view of the bottom handling device approaching the bottom of the pipe, according to one or more embodiments.

In FIG. 3C, the top drive 4 (shown in FIG. 1) may set the tubular 6, 6' down on the rig floor 11. The robotic arm 12 (shown in FIG. 2A) may engage the upper end of the tubular 6, 6' and hold its plan view position such that the tubular is in a stable position supported by the drill floor and prevented from tipping by the robotic arm 12. The elevator of the top drive may then disconnect from the tubular 6, 6'.

Figure 3D:
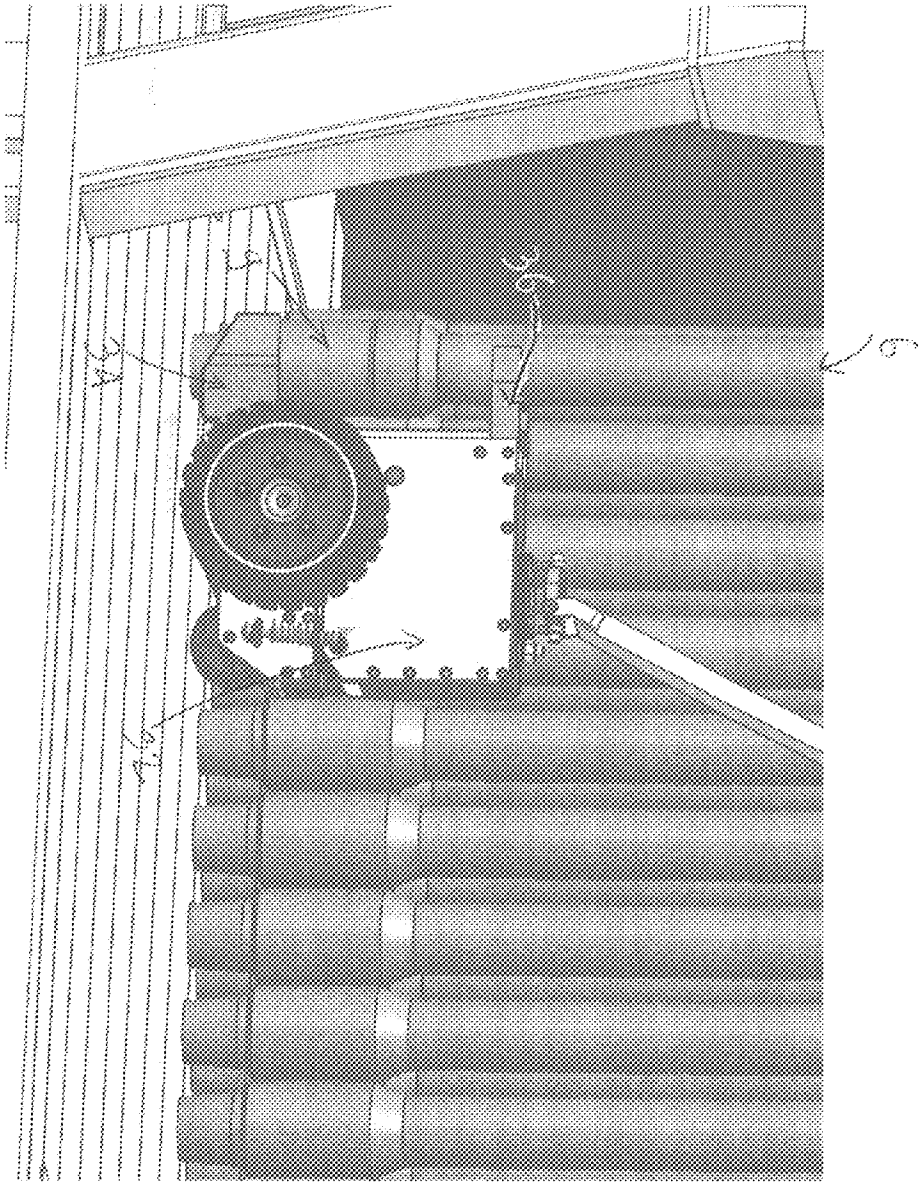
FIG. 3D is a close-up view thereof, according to one or more embodiments.

As shown in FIG. 3D, the fork 34 of the rig-floor pipe lifting machine 32 may slide under the tool joint 9 of the tubular 6. The tubular 6 may rest against the concave pad 36 of the rig-floor pipe lifting machine 32.

Figure 3E:
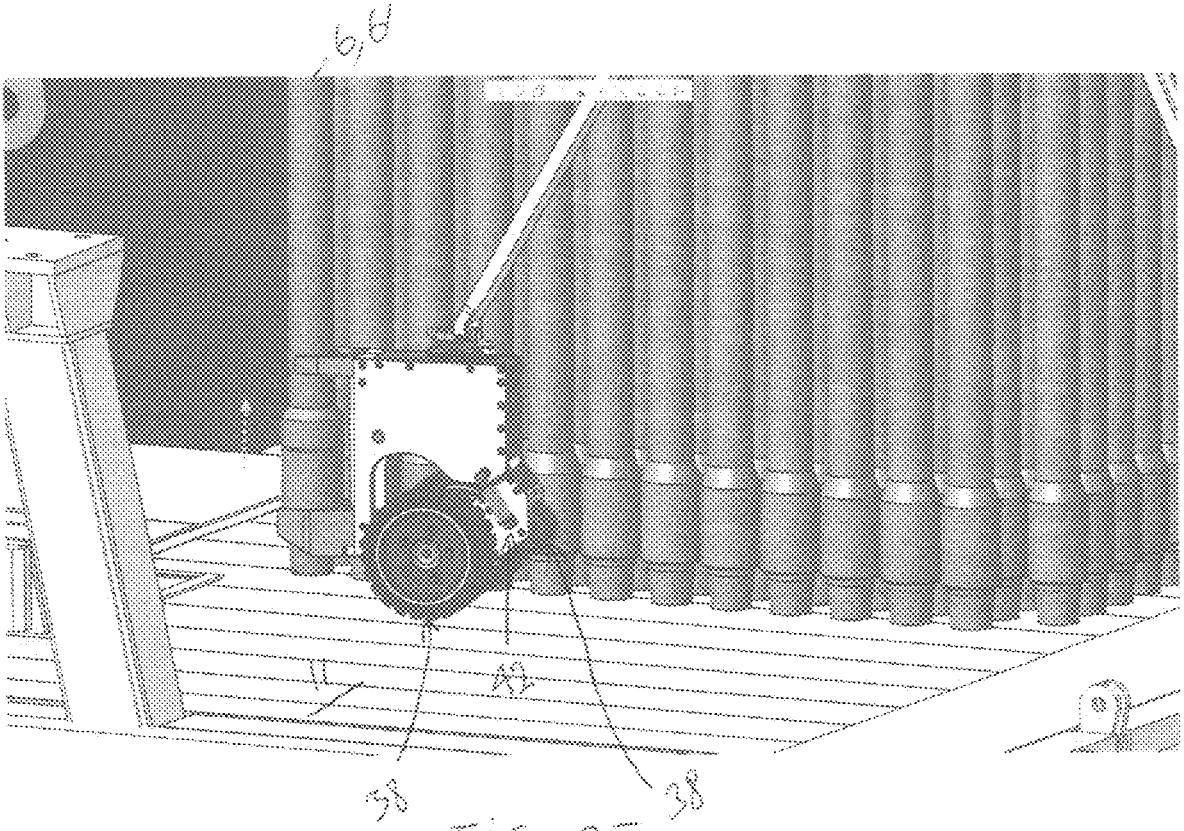
FIG. 3E is a perspective view of the bottom handling device having a lifted balance wheel, according to one or more embodiments.

In FIG. 3E, a lift actuator (e.g., a hydraulic cylinder having a first cylinder end coupled to at least one of the pair of swing arms 42 and a second cylinder end coupled to the frame of the rig-floor pipe lifting machine 32) may be used to rotate the pair of swing arms 42 relative to the frame of the rig-floor pipe lifting machine 32. As such, the tubular 6, 6' may be lifted from the rig floor 11, and the weight of the tubular 6, 6' may be supported by a subset of the plurality of wheels 38 (e.g., the drive wheels). As may be appreciated, the offset nature of the fork 34 relative to the wheels 38 may cause the pad 36 to tend toward the tubular and engage the tubular. The link 40 can be used as a path to deliver power (e.g., hydraulic power) to the lift actuator. Then, the first catcher arm 20 and the second catcher arm 28 may be moved in the directions reverse from the arrow 16 and 24 (shown in FIG. 2B), respectively.

Figure 3F:
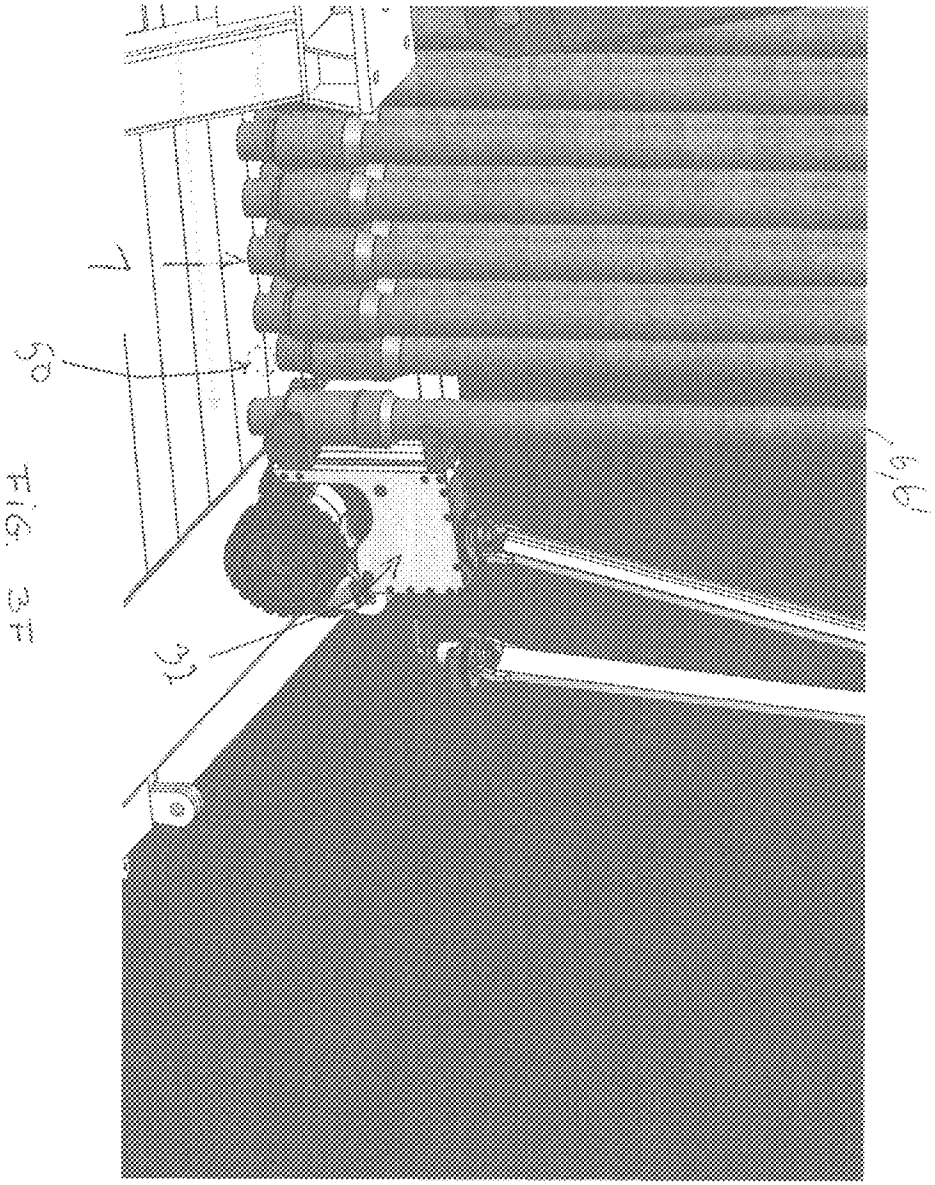
FIG. 3F is a perspective view of the bottom handling device placing the drill pipe in the setback area.

In FIG. 3F, the movements of the rig-floor pipe lifting machine 32 and of the robotic arm 12 (shown in FIG. 2A) may be synchronized or coordinated to displace the tubular 6, 6' toward an unoccupied storage location 50 in the setback area 7 and/or fingerboard 5.

Figure 3G:
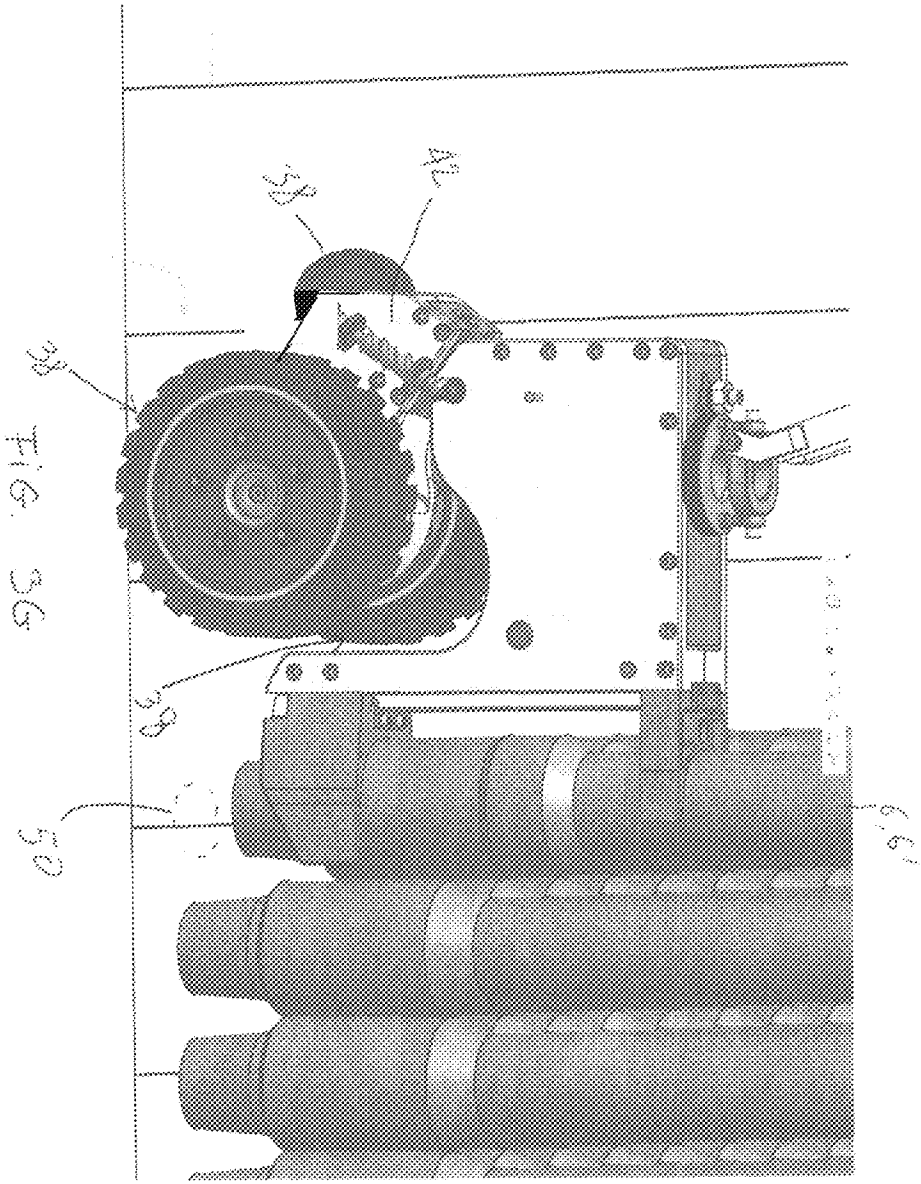
FIG. 3G is a close-up view thereof, according to one or more embodiments.

In FIG. 3G, a subset of the plurality of wheels 38 (i.e., the drive wheels) may be driven in opposite directions to turn the rig-floor pipe lifting machine 32. The tubular 6, 6' may be positioned above the unoccupied storage location 50.

Figure 3H:
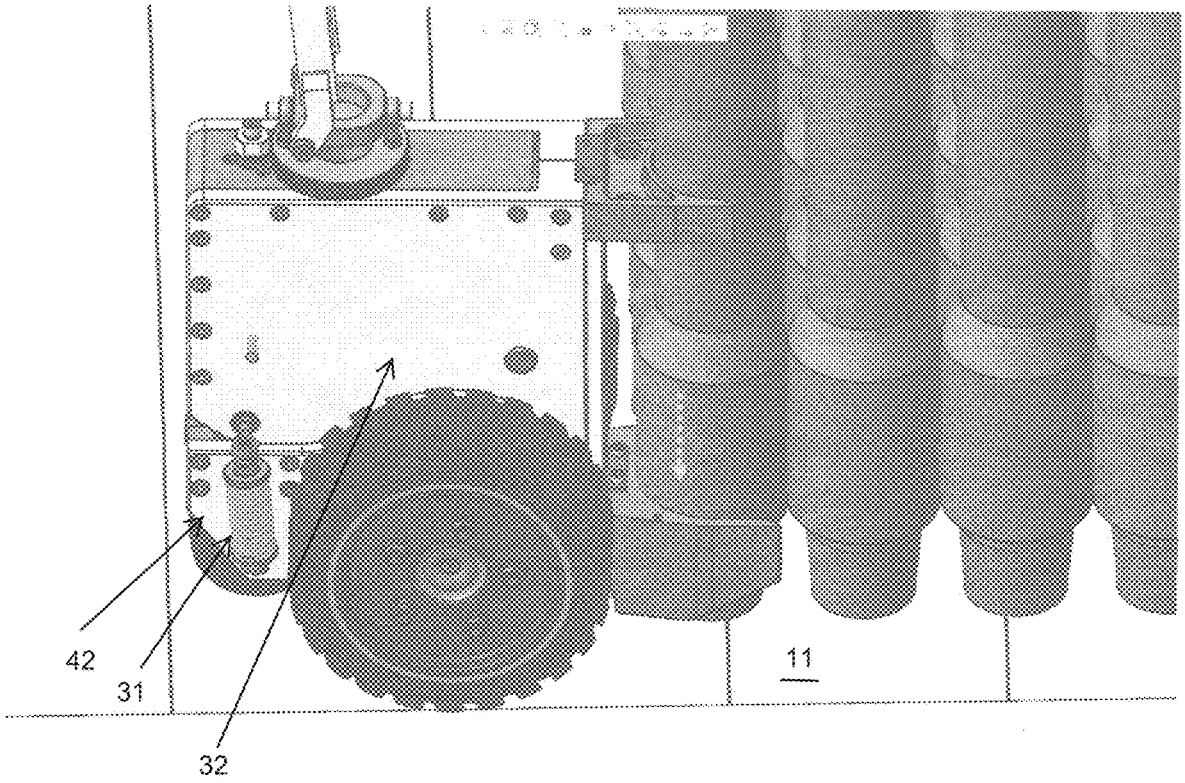
FIG. 3H is a close-up view thereof with pipe being set down, according to one or more embodiments.

In FIG. 3H, the lift actuator may be used to rotate the pair of swing arms 42 relative to the frame of the rig-floor pipe lifting machine 32 in the opposite as compared to the direction in FIG. 3E. As such, the tubular 6, 6' may be set on the rig floor 11 and the weight of the tubular 6, 6' may be supported by the rig floor 11.

Figure 3I:
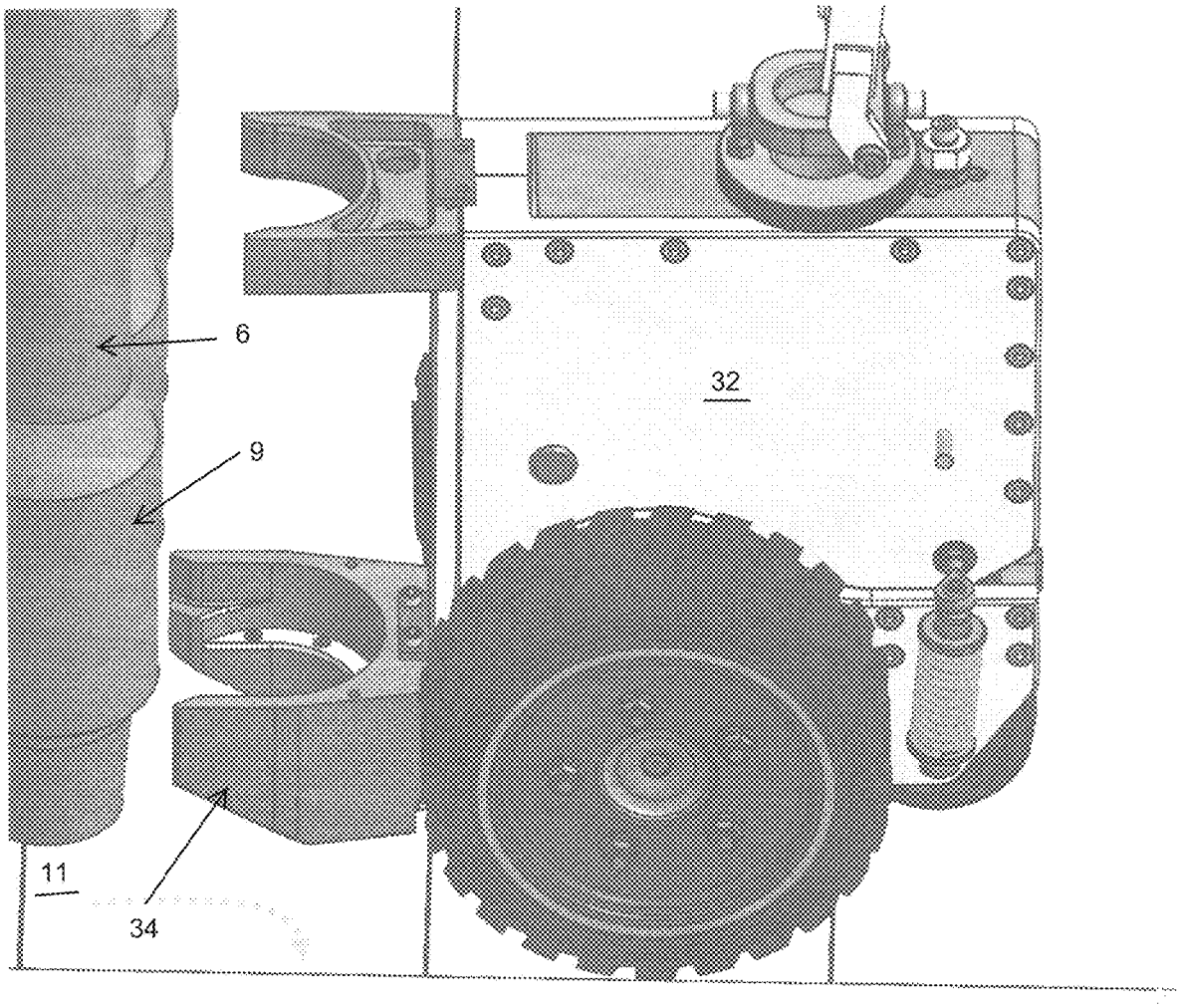
FIG. 3I is a close-up view thereof with the bottom handling device disengaged from the pipe, according to one or more embodiments.

In FIG. 3I, the fork 34 of the rig-floor pipe lifting machine 32 may slide out from under the tool-joint 9 of the tubulars 6, 6'. The robotic arm 12 (shown in FIG. 2A) may release the upper end of the tubular 6, 6'.

The cycle of steps illustrated in FIGS. 3A-3I may be repeated with another tubular 6, 6' coming out of the well 10.

The sequence of steps illustrated in FIGS. 3A-3I may also be reversed. As such, in accordance with an embodiment of the invention, the system for handling the tubulars can be used to deploy tubulars into the well 10.

The system for handling the tubulars in accordance with the embodiment of the present application may be readily retrofittable on existing rigs. That is, for example, the top handling device may be mounted on the mast 2, below the fingerboard 2. Further, the crossbars 18/26 may be clamped, welded, or otherwise secured to the mast 2, and or additional beams 2' may be connected between the mast 2 and the rig floor 11. Still further, because the rig-floor pipe lifting machine 32 is powered by a plurality of wheels 38, its implementation does not require the addition of rails or other guiding devices on the rig floor 11. Also, the sensors for controlling the position and/or movement of the rig-floor pipe lifting machine 32 and the power delivery to the rig-floor pipe lifting machine 32 can conveniently be provided by the link 40, therefore localizing the connections to the rig-floor pipe lifting machine 32 along a single path to avoid encumbering the setback area 7 and/or the V-door area with multiple wires and conduits.

In another embodiment shown in FIGS. 4-8, a rig floor pipe lifting machine 132 may be controlled, positioned, or driven more externally. For example, a link, robot or articulable assembly 140 may be provided in lieu of the link 40. The articulable assembly 140 may be adapted to provide power, communications, and positional information of the rig floor pipe lifting machine as before, but the articulable assembly may also be configured to controllably position the rig floor pipe lifting machine 132. The articulable assembly may include a base 142, an inner boom 144, an outer boom 146, and a head portion 148.

Figure 4:
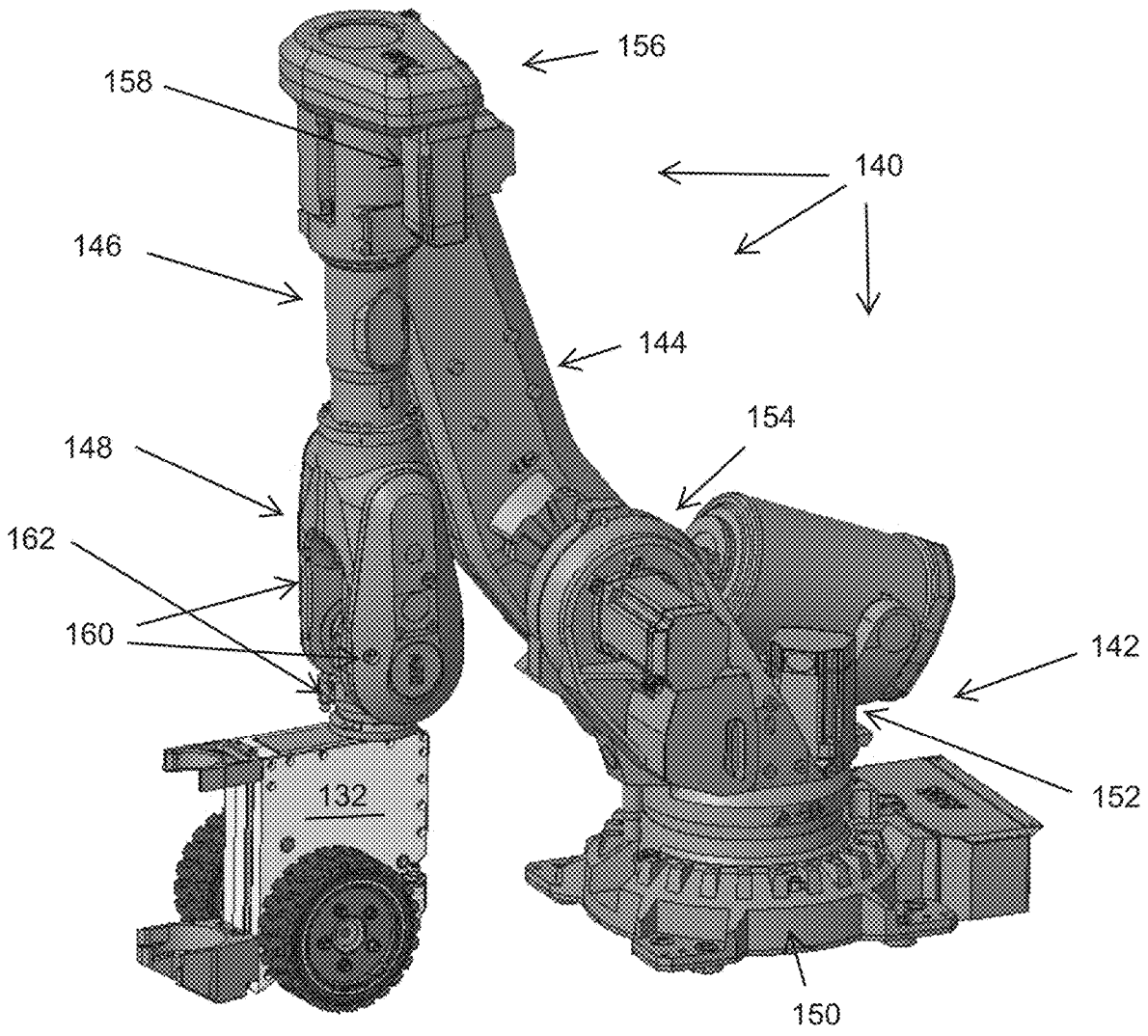
FIG. 4 is a perspective view of a bottom handling device, according to one or more embodiments.
Figure 5:
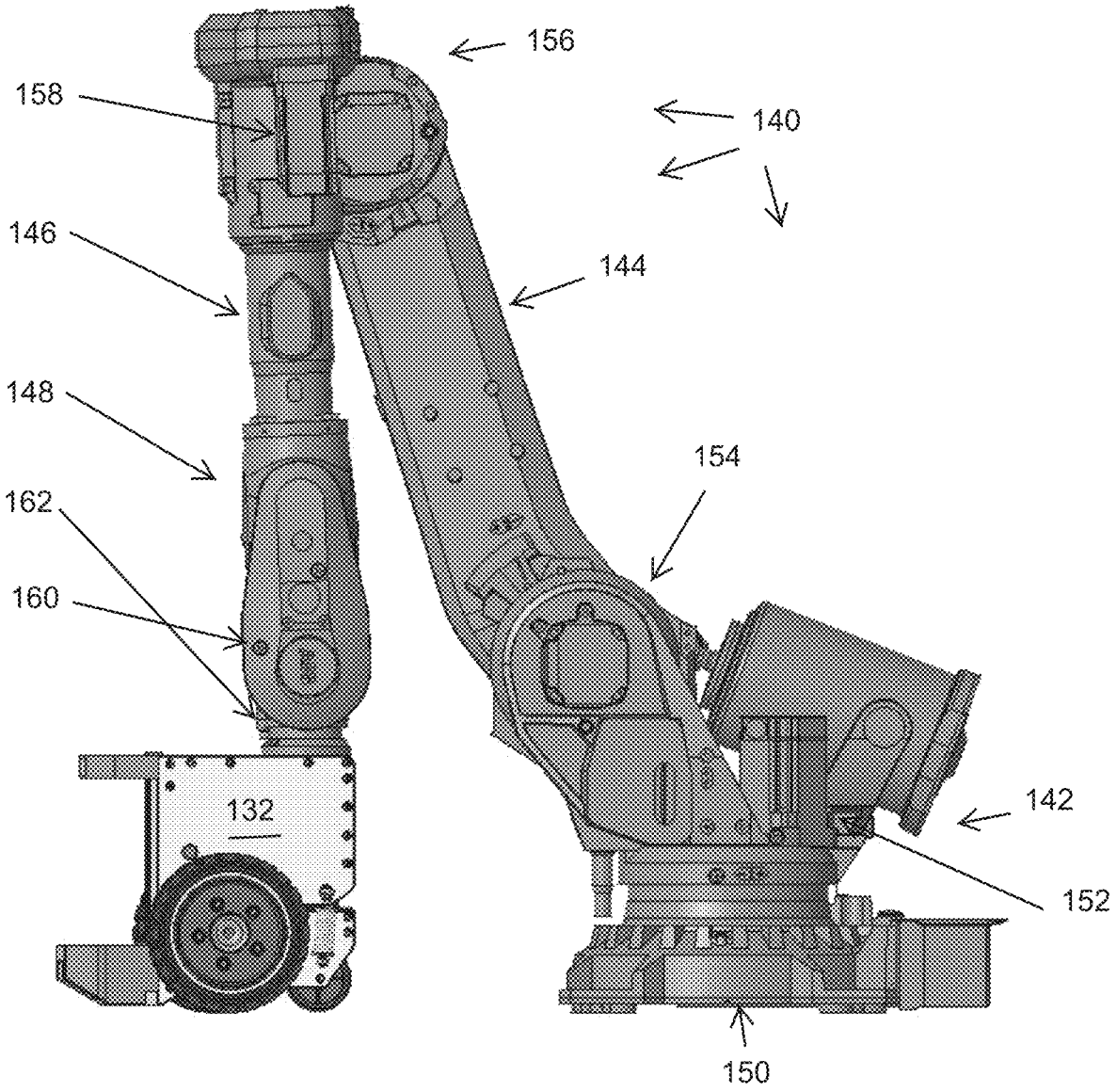
FIG. 5 is a side view thereof, according to one or more embodiments.

Referring to FIGS. 4 and 5, the base 142 may be configured for attachment of the inner boom 144 and providing for rotation of the inner boom about a vertical and a horizontal axis. The base 142 may include a floor assembly 150 for securing the base to the floor and rotatably supporting the inner boom. That is, as shown, the floor assembly may include brackets for securing the base to the floor. The floor assembly 150 may also include an annular housing surrounding or enclosing a floor bearing establishing a plane in which the bottom of the inner boom can pivot about a vertical axis. The floor assembly may also include a rotational position control 152 including a rotational gear assembly and an associated motor. The rotational gear assembly and the associated motor may provide for rotation of the inner boom and, thus, the articulable assembly relative to the base.

The base may also include a pivoting control portion 154 configured to control the pivoting position of the inner boom relative to the base. As shown, the pivoting control portion may include a hydraulic ram offset from the pivot axis of the inner boom and adapted to extend to pivot the inner boom downward about the pivot point and retract to pivot the inner boom upward about the pivot point. The pivoting control portion may also include a motor for causing the same or similar motion.

The inner boom 144 of the articulable assembly may be configured to be pivoted and rotated about the base 142 and for lifting and controlling the position of the outer elements of the articulable assembly 140 and the rig floor lifting machine. The inner boom may extend away from the base to a knuckle or additional pivot point 156 about which an outer boom 146 may pivot. The inner boom 144 may be a substantially strong arm configured to carry the weight of the rig floor lifting machine 132 at relative long distances. The inner boom 144 may include a built-up or cast element or a more standard section such as a tube, pipe, or other structural member may be used.

The outer boom 146 of the articulable assembly may be configured to be pivoted about the knuckle 156 relative to the inner boom 144 and to control the position of the head 148 and rig floor lifting machine relative to the inner boom. The outer boom 146 may extend away from the knuckle 156 to the head 148 and may be a substantially strong arm configured to carry the weight of the rig floor lifting machine 132. The inner boom may include a built up or cast element or a more standard section such as a tube, pipe, or other structural member may be used.

The outer boom 146 may be pivoted relative to the inner boom 144 by way of a motor assembly driving a gear system. As shown, a gear assembly may be arranged at the knuckle where the inner and outer booms meet and powering of the motor may cause the outer boom to articulate relative to the inner boom.

The inner boom 144 may also include a head swivel control 158. The head swivel control 158 may be arranged to cause pivoting motion of the head about an axis extending along the longitudinal axis of the outer boom 146. For example, as shown, the head swivel control 158 may include a motor and gear box arranged on the back end of the outer boom near the knuckle. Powering of the motor may cause rotation of the gear box and rotation of the head relative to the outer boom and about the longitudinal axis of the outer boom.

The head 148 may be positioned on an outer most end of the outer boom 146 and may be adapted for swiveling motion relative to the outer boom and for pivotally engaging the rig floor lifting machine 132. That is, the head may include a jaw structure 160 with yet another pivoting component 162 arranged therein. The jaw component 160 may include a pair of opposing arms or plates extending away from the outer boom and forming a receiving space therebetween. A dual swivel mechanism 162 may be arranged on the top of the rig floor lifting machine 132 and the dual swivel mechanism may allow the rig floor lifting machine to pivot about a vertical axis relative to the jaw 160 and to pivot about a horizontal axis relative to the jaw where horizontal and vertical are relative to the drill floor (e.g., where the drill floor is arranged horizontally).

Figure 6:
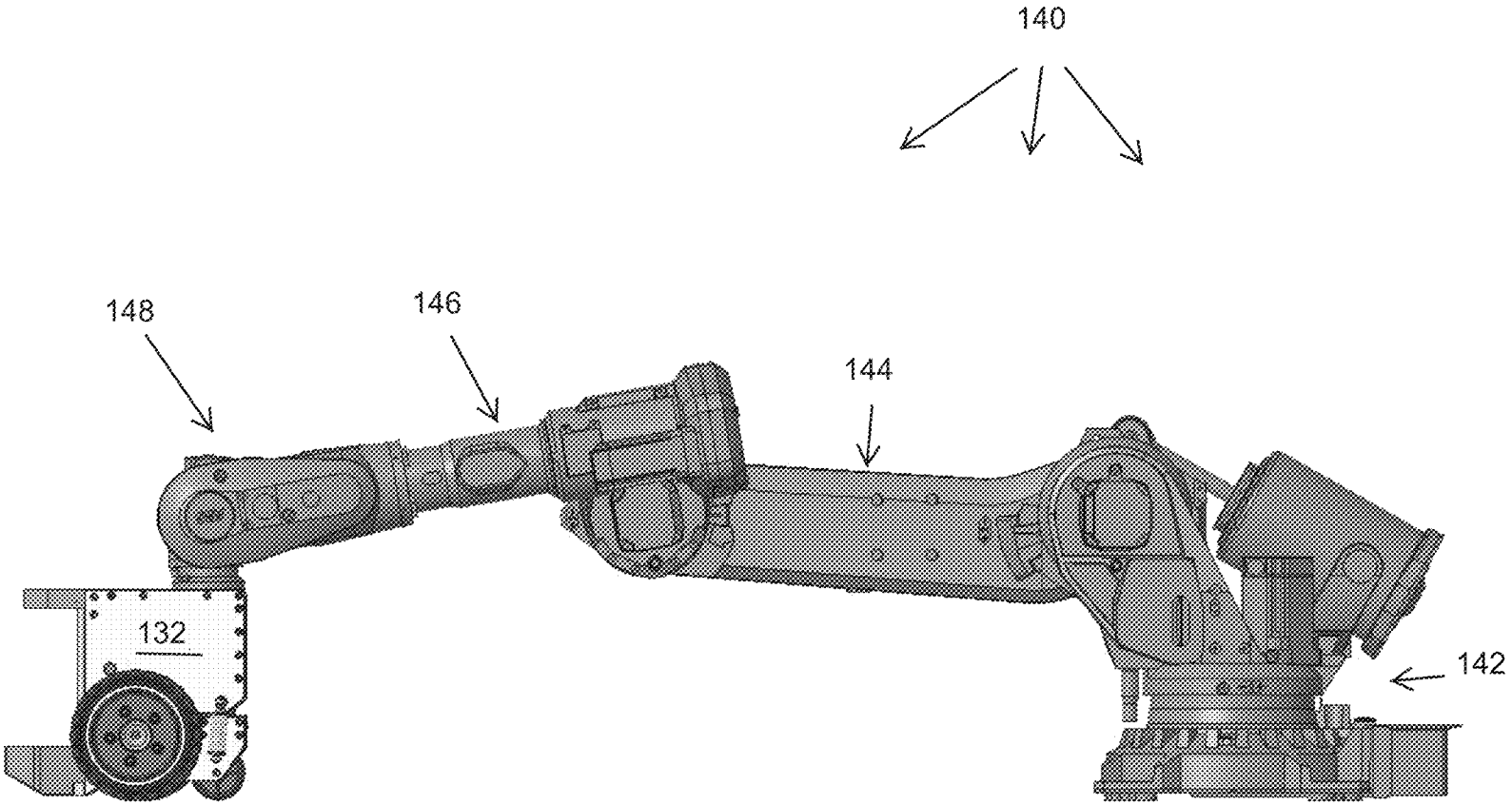
FIG. 6 is a side view thereof with a control arm in an extended position.

As shown in FIG. 6, the articulable assembly 140 may be adapted to extend outward by lowering the inner boom 144 and extending the outer boom 146 about the knuckle 156. This may provide for a relatively large amount of reach of the assembly 140 and may allow the rig floor lifting machine 132 to reach substantial distances across the rig floor 11. Moreover, the rotational motion at the base 142 of the articulable assembly 140 may provide for this reach across a large area of the drill floor.

Figure 7:
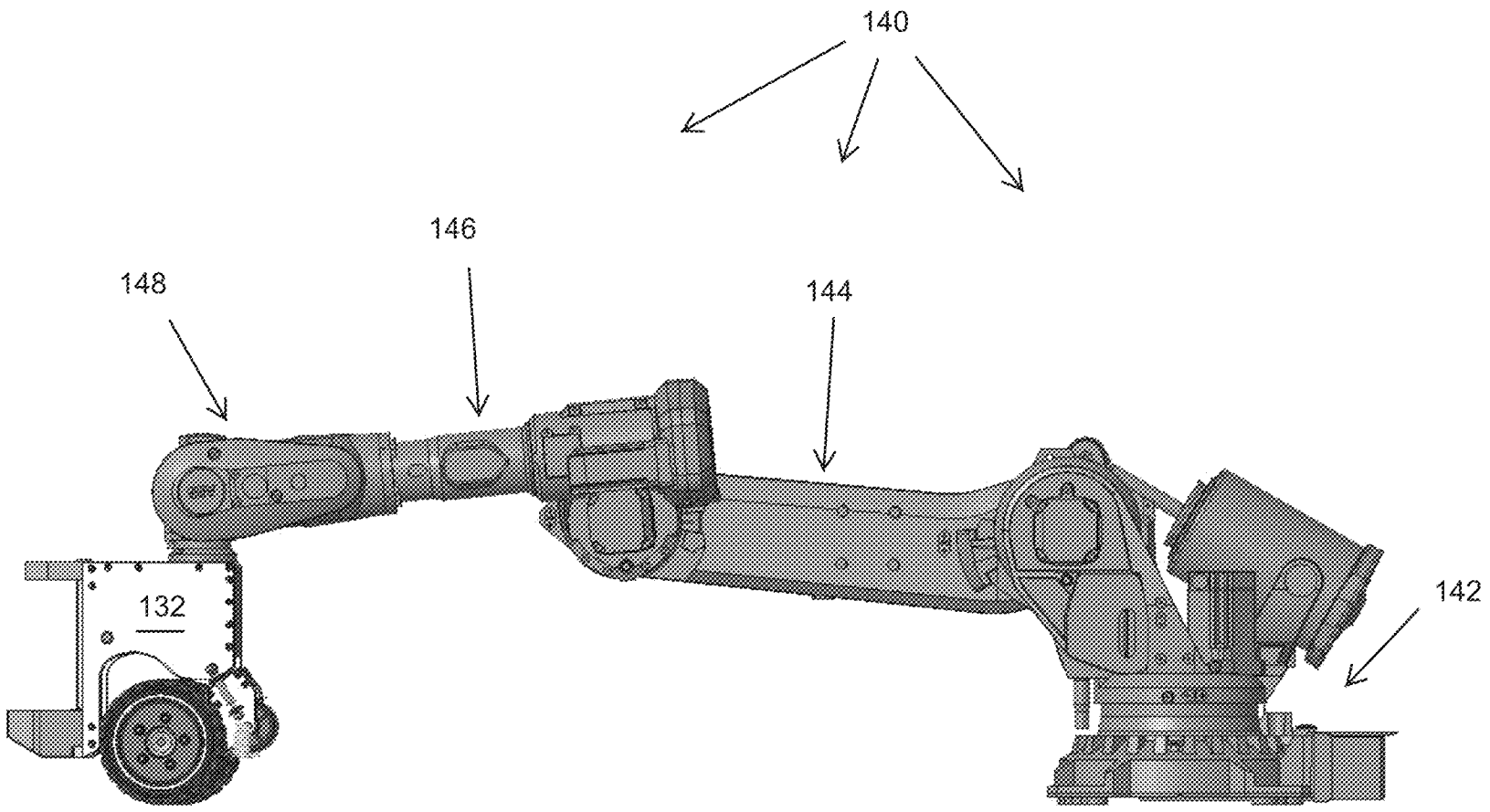
FIG. 7 is a side view with the control arm in the extended position and the balance wheel of the floor device in a lifted position.

With reference to FIG. 7, and as shown and described with respect to FIG. 3, the rig floor lifting machine 132 may be adapted to lift its rear caster wheel 38 when engaging or lifting pipe so as to provide for a higher level of maneuverability based on two wheel rotation in the same or opposite directions allowing the rig floor lifting device to pivot and move about the drill floor in very precise and controlled motions. As such, the rig floor lifting device 132 motion may be coordinated with the top handling device to suitably move tubulars to and from the setback area.

Figure 8:
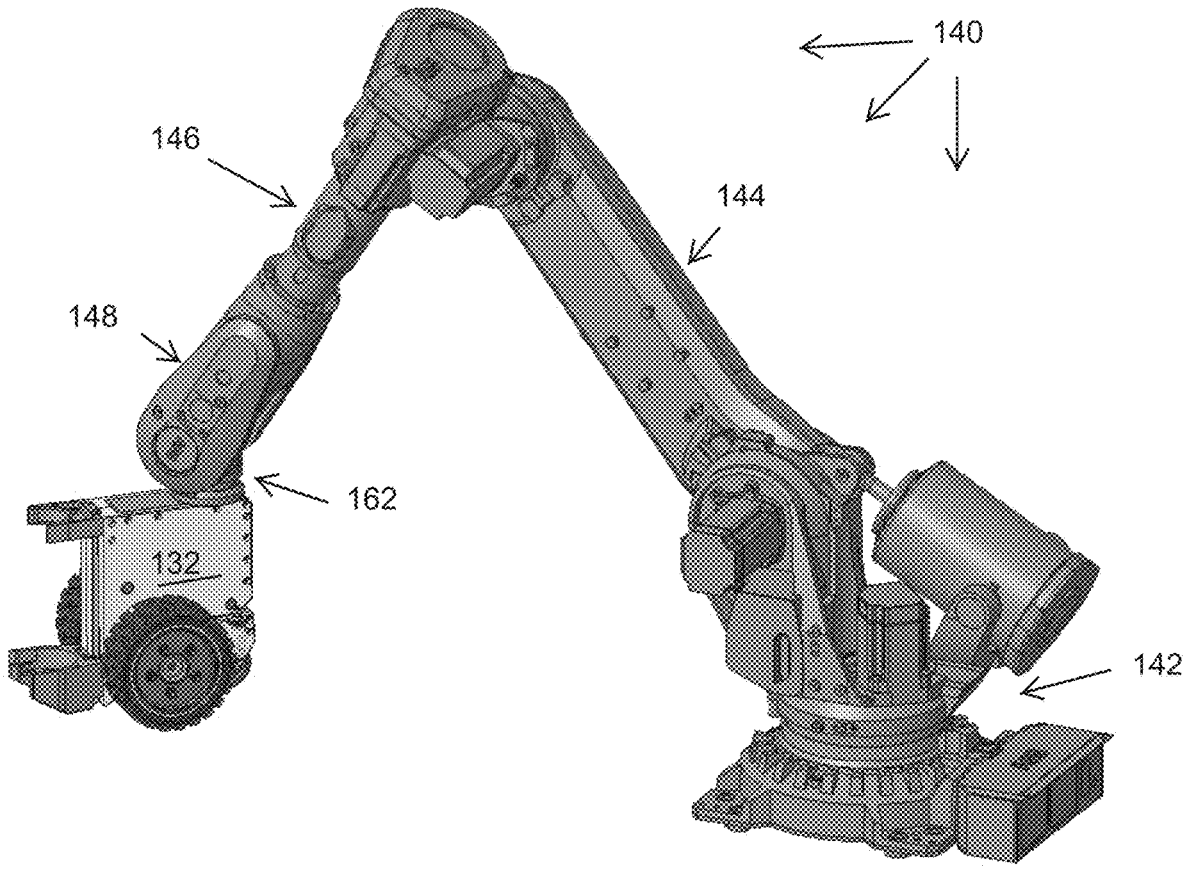
FIG. 8 is a perspective view of the bottom handling device with the floor device pivoted relative to the plane of the arm system, according to one or more embodiments.

As shown in FIG. 8, the versatility of the articulable assembly 140 is shown where the rig floor lifting machine 132 is in an intermediate position between a fully extended articulable assembly and a fully retracted articulable assembly. As shown, the inner boom 144 may be rotated about a vertical axis to a desired position and pivoted downward from its most upright position. The outer boom 146 may also be pivoted about the knuckle 156.

The head 148 of the articulable assembly may secure the dual swivel mechanism 162 between its arms 160 and the dual swivel mechanism 162 may be swiveled in two directions causing the rig floor lifting machine 132 to be arranged vertically below the head 148 and pivoted relative to the plane of the inner and outer booms 144, 146.

In one or more embodiments, as shown, the articulable assembly 140 may include an ABB IRB 6660-205. However, still other options may be available and selections may be based on design factors including, for example, the potential payload and the potential reach of the system. The articulable assembly 140 may provide for many degrees of control and motion. The articulable assembly 140 may allow for positioning the head 148 at any position and at any angle and may further be able to float in situations where the bottom handling device 132 may control its own position and motion.

It is to be appreciated that while the articulable assembly 140 may be adapted to more positively control the position of the rig floor lifting machine as compared to the link 40, the rig floor lifting machine may continue to do the work of lifting and handling of tubulars. That is, in an effort to avoid having the articulable assembly become overly heavy and bulky, the articulable assembly may be adapted to lift and carry the rig floor lifting machine so as to have the ability to reposition the machine and control the position of the machine, but may avoid being designed to carry the weight of drill pipe or tubulars. As such, the rig floor lifting machine may include at least two conditions; a lifting and carrying condition and a free condition. In the lifting and carrying condition, the rig floor lifting machine may be configured for engaging and lifting and carrying pipe to a setback area. In this condition, the articulable assembly may be configured to float and/or follow the rig floor lifting machine without inhibiting its motion. That is, the joints and controls of the articulable assembly may passively follow the rig floor lifting machine. More particularly, the x, y, and z positions of the articulable assembly may be allowed to float and allow the rig floor lifting machine to push both the tubular and the articulable assembly. However, the articulable assembly may remain in a monitoring state so that the position of the rig floor lifting machine may be monitored. In a free condition, the rig floor lifting machine may act passively. That is, the articulable assembly may guide, lift, push, or otherwise control the position of the rig floor lifting machine so as to more accurately, quickly, or suitably position the rig floor lifting machine. In still other embodiments, in the lifting and carrying condition, the rig floor lifting machine may lift and carry the weight of the tubular, but articulable assembly may continue to control the motion of the rig floor lifting machine about the rig floor. As such, the articulable assembly may push, pivot, and/or pull the rig floor lifting machine about the rig floor to move the tubular from the release position to the setback area and/or vice versa.

In one or more embodiments, the rig floor lifting machine may be hydraulically actuated and the articulable assembly may be electrically driven. In one or more embodiments, the opposite may be true or a combination of hydraulic and electric power may be provided.

It is to be appreciated that the bottom handling device described with respect to FIG. 2C and the bottom handling device described with respect to FIGS. 4-8 may each perform the functions and operations set forth in FIGS. 3A-3I and that nothing in the application should limit the method to be performed to one of the systems or the other. The features and capabilities of the systems may be taken into account with respect to how the method is performed where, for example, the system described with respect to FIGS. 3A-3I may operate in the conditions mentioned (i.e., lifting and handling condition and/or free condition).

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A system for handling tubulars on a rig, comprising:

a top handling device configured for arrangement on the rig and for handling a top portion of a tubular to and from a setback area;

a lower handling device configured for arrangement on the rig and for handling a bottom portion of the tubular between well center and a release position; and a bottom handling device configured for:

arrangement on a drill floor of the rig; and freely maneuvering about the rig floor while lifting the tubular from the drill floor via the bottom portion of the tubular and carrying the tubular between the release position and the setback area, the bottom handling device comprising an articulable assembly having a first condition and a second condition, wherein, in the first condition, a drive wheel positions the bottom handling device relative to the tubular, thus, allowing the articulable assembly to float and, in a second condition, the articulable assembly controls the position of the bottom handling device.

2. The system of claim 1, wherein the lower handling device comprises a pair of swing arms configured to establish a V-shaped guide and guide the bottom portion from well center to the release position.

3. The system of claim 1, wherein the bottom handling device comprises a rig floor lifting machine.

4. The system of claim 3, wherein the drive wheel comprises a pair of drive wheels and the rig floor lifting machine comprises an aligned fork and pad offset from an axle of the pair of drive wheels so as to balance and align with the tubular when the fork lifts the tubular.

5. The system of claim 3, wherein the articulable assembly is configured to provide power and data between a control point and the rig floor lifting machine.

6. The system of claim 1, wherein the articulable assembly comprises:

a base;

an inner boom rotationally and pivotally extending from the base to a knuckle;

an outer boom pivotally extending from the knuckle to an outer end;

a head arranged on the outer end of the outer boom; and a dual swivel mechanism arranged on the head and configured to engage the rig floor lifting machine.

7. The system of claim 6, wherein the articulable assembly is configured to lift and control the position of the rig floor lifting machine.

8. A tubular handling device for handling tubulars on a rig floor, comprising:

a rig floor lifting machine having a pipe lifting and carrying condition and a free condition, wherein, in the pipe lifting and carrying condition, the rig floor lifting machine is configured to engage a bottom portion of a tubular, lift the tubular from the rig floor, and freely maneuver while carrying the tubular to a setback area; and an articulable assembly having a first condition and a second condition, wherein, in the first condition, a drive wheel positions the bottom handling device relative to the tubular, thus, allowing the articulable assembly to float and, in the second condition, the articulable assembly controls the position of the rig floor lifting machine.

9. The tubular handling device of claim 8, wherein the articulable assembly comprises:

a base;

an inner boom rotationally and pivotally extending from the base to a knuckle;

an outer boom pivotally extending from the knuckle to an outer end;

a head arranged on the outer end of the outer boom; and a dual swivel mechanism arranged on the head and configured to engage the rig floor lifting machine.

10. The tubular handling device of claim 8, wherein the drive wheel comprises a pair of drive wheels and the rig floor lifting machine comprises an aligned fork and pad offset from an axle of the pair of drive wheels so as to balance and align with the tubular when the fork lifts the tubular.

11. A method of handling tubulars on a rig, the method comprising:

decoupling a tubular from a pipe string;

swinging the tubular from well center to a release area and setting the tubular on the drill floor with a top drive elevator;

moving a rig floor lifting machine to the release area with an articulable assembly;

with the rig floor lifting machine;

engaging the tubular;

lifting the tubular from the rig floor; and freely maneuvering the rig floor lifting machine using a drive wheel thereon and while carrying the tubular to a setback area; and with an articulable assembly, selecting between a first condition and a second condition wherein, in the first condition, the articulable assembly floats and, in the second condition, the articulable assembly controls the position of the rig floor lifting machine.

12. The method of claim 11, wherein engaging the tubular with the rig floor lifting machine comprises lifting the tubular with a fork.

13. The method of claim 12, wherein engaging the tubular with the rig floor lifting machine comprises self-aligning of the rig floor lifting machine under the weight of the tubular.

14. The method of claim 13, wherein freely maneuvering comprises disengaging a caster wheel.

15. The method of claim 11, further comprising releasing the tubular with the top drive elevator and controlling the position of the top of the tubular.

16. The method of claim 15, wherein moving the rig floor lifting machine to the release area with an articulable assembly comprises controllably positioning the rig floor lifting machine with the articulable assembly.

17. The method of claim 16, further comprising transitioning the rig floor lifting machine and the articulable assembly from a free condition to a lifting and carrying condition.

18. The method of claim 17, wherein in the free condition, the rig floor lifting machine is passive and the articulable assembly is active.

19. The method of claim 18, wherein in the lifting and carrying condition, the rig floor lifting machine is active and the articulable assembly is passive.

* * * * *